US007790662B2

(12) United States Patent
Sahin Topkara et al.

(10) Patent No.: US 7,790,662 B2
(45) Date of Patent: Sep. 7, 2010

(54) PERFUMING METHOD AND PRODUCT

(75) Inventors: Hilal Sahin Topkara, Zaventem (BE); Alex James Orchard, Brussels (BE); Peter Gerard Gray, Brussels (BE); Manuel Mariani, San Lazzaro di Savena (IT); Giovanni Carrara, Sambuceto di S. Giovanni Teatino (IT); Ingrid Merere, Wemmel (BE); James Charles Theophile Roger Burckett St. Laurent, Brussels (BE); Johan Smets, Lubbeck (BE); Regis d'Hardemare, Brussels (BE); Hugo Robert Germain Denutte, Hofstade-Aalst (BE)

(73) Assignee: The Procter & Gamble Company, Cincinnati, OH (US)

( * ) Notice: Subject to any disclaimer, the term of this patent is extended or adjusted under 35 U.S.C. 154(b) by 983 days.

(21) Appl. No.: 11/516,355

(22) Filed: Sep. 6, 2006

(65) Prior Publication Data

US 2007/0072785 A1 Mar. 29, 2007

Related U.S. Application Data

(60) Provisional application No. 60/714,461, filed on Sep. 6, 2005.

(51) Int. Cl.
*C11D 3/50* (2006.01)

(52) U.S. Cl. ..... 510/101; 510/276; 510/277; 510/293; 510/406; 510/438; 510/439; 510/441; 510/523

(58) Field of Classification Search ..... 510/101, 510/276, 277, 293, 406, 438, 439, 441, 523
See application file for complete search history.

(56) References Cited

U.S. PATENT DOCUMENTS

| | | | | |
|---|---|---|---|---|
| 4,858,758 | A * | 8/1989 | Mitchell et al. | 206/205 |
| 5,089,167 | A * | 2/1992 | Coyne et al. | 252/186.26 |
| 5,211,874 | A | 5/1993 | Haendler et al. | |
| 2005/0272624 | A1 * | 12/2005 | Hardy et al. | 510/296 |

OTHER PUBLICATIONS

International Search Report, mailed Dec. 29, 2006, 3 pages.

* cited by examiner

*Primary Examiner*—Charles I Boyer
(74) *Attorney, Agent, or Firm*—Armina E. Matthews; Marianne Dressman; Leonard W. Lewis

(57) ABSTRACT

One aspect of the invention relates to a laundry detergent product comprising (a) a package comprising (1) a container; and (2) a closure; (b) a fluid laundry detergent pourable at ambient storage temperature and comprising at least one material copourable from the package with the fluid laundry detergent, wherein the material is selected from: (1) a detergent-copourable perfume composition; (2) a fabric care additive; (3) a laundry-specific detersive additive; (4) an enzyme; (5) a volatile malodorous compound; and (6) any combination thereof; (c) a headspace; and (d) a detergent-non-copourable perfume composition. Another aspect of the invention relates to methods for making or assembling the fluid laundry detergent package.

28 Claims, 6 Drawing Sheets

PERFUMING METHOD AND PRODUCT

CROSS REFERENCE TO RELATED APPLICATION

This Application claims priority to U.S. Provisional Application Ser. No. 60/714,461, filed Sep. 6, 2005.

BACKGROUND OF THE INVENTION

Fluid laundry detergent products are well-known as a distinct consumer product category which has unique challenges associated with formulation and packaging. Such products commonly contain perfume, and are sold in packages such as bottles, from which the product is poured through a relatively wide-necked pouring spout. Consumers generally desire a clean and fresh odor whenever they open the package and smell the product, as well as at later points in their laundering experience such as a clean and fresh odor in the laundry room, and on laundered clothing.

Perfumed laundry detergent products such as heavy-duty liquid detergents continue to have many shortcomings. For example, perfumes are complex mixtures of costly ingredients and are often chemically reactive or incompatible with liquid laundry detergent products. This can adversely affect both the perfumes and the materials with which they interact. Further, these compatibility problems can be much greater than those encountered in the case of solid form detergents or with technically simpler cleaning products such as toilet bowl cleaners, automatic dishwashing products, shampoos or dishwashing agents. Shampoos and hand dishwashing products, in particular, are sold in packages having restricted orifices through which the products are squeezed, and therefore do not have a large opening through which a consumer can smell the product.

In contrast to solid form detergents, fluid detergent ingredients may contain certain components with undesirable odor and further, liquid laundry detergents contain a challenging array of adjuncts that make perfume stabilization difficult. Moreover a major fraction of the costly perfumes can be lost "down the drain" when the product is used to wash clothes in an automatic laundry washing machine. Finally, the detergent must have an overall perfume character that is acceptable to consumers.

What is therefore needed are laundry detergent products, especially pourable packaged heavy-duty liquid laundry detergents, that provide improved perfume impression on opening the package, improved efficiency of use of perfumery ingredients, better compatibility of perfume and detergent, better perfume impression at various points during use of the product and on the laundered textiles thereafter, the ability to incorporate a range of modern performance adjuncts, and the ability to effectively control any malodor of commonly available detergent materials.

These needs must be met in a manner consistent with satisfying consumers with respect to the olfactory character of perfumes that they seek in the specific context of fabric laundering, and without incurring manufacturing complexity increase as the components of package and detergent are assembled into the product that is to be sold.

SUMMARY OF THE INVENTION

One aspect of the invention relates to a laundry detergent product comprising (a) a package comprising (1) a container, typically a bottle, and (2) a closure;

(b) a fluid laundry detergent pourable at ambient storage temperature and comprising at least one material copourable from the package with the fluid laundry detergent, wherein the material is selected from:

(1) a detergent-copourable perfume composition, typically this means one or more perfume compositions that pour out from the bottle in contrast with a non-copourable perfume composition described hereinbelow;

(2) a fabric care additive, typically this can include one or more of cationic fabric softeners, silicone polymers, dye fixatives, dye transfer inhibitors, cationic gums, and mixtures thereof;

(3) a laundry-specific detersive additive, typically this can include one or more optical brighteners, fabric laundering-compatible nonstaining dyes, fabric compatible bleaches, laundry soil release polymers, laundry soil suspending polymers and mixtures thereof;

(4) an enzyme, typically a protease, amylase, cellulase, lipase or mixtures thereof;

(5) a volatile malodorous compound, typically a malodorous compound found in commercial grades of detergent surfactants or softeners; and (6) any combination thereof;

(c) a headspace (suitable for olfactory sampling by a consumer on opening the closure); and (d) a detergent-non-copourable perfume composition, non-copourability with the fluid laundry detergent being determined at ambient storage temperatures, e.g., about 25° C.; typically this latter component is non-copourable in the sense that under normal use conditions, it does not come out of the package when the detergent is poured out. In order to accomplish this, the non-copourable composition preferably remains in solid (including highly viscous glass or gel) form under ambient storage temperatures, and is preferably either affixed internally to the package (either directly or using a separate adhesive) or affixed to an object having dimensions larger than those of the opening of the package; provided that the fluid laundry detergent, the headspace, and the detergent-non-copourable perfume composition are contained together in the package such that when the package is greater than 50% full (v/v) of fluid laundry detergent, the fluid laundry detergent is capable of wetting the detergent-non-copourable perfume composition when the package is inverted; and (ii) volatilization of potentially volatile components of the product selected from components (b)(1), (b)(5) and (d) into the headspace is possible.

Typically the headspace is positioned above the fluid laundry detergent or can be brought into position above the fluid detergent composition by tilting the package, such that on opening the closure, the headspace may be olfactorily sampled by a consumer without pouring the fluid laundry detergent from the package; and wherein the detergent-non-copourable perfume composition has a physical form other than that of a protected closure liner or of an O-ring holding perfume that can be squeezed out on securing the closure.

Another aspect of the invention relates to methods for making or assembling the fluid laundry detergent package.

Figure 1:
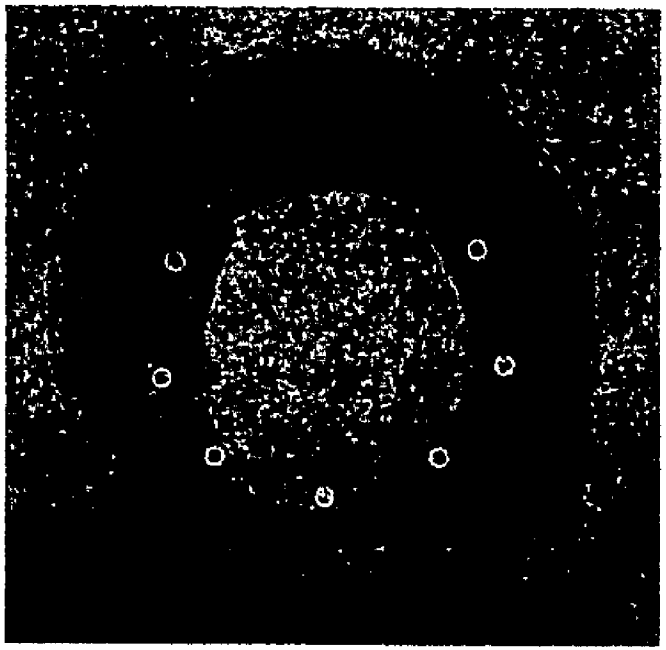
FIG. 1 shows a detergent-non-copourable perfume composition as small spots adhered to and evenly distributed around the inner bottom surface of the circumference of a transition component of a package.
Figure 2:
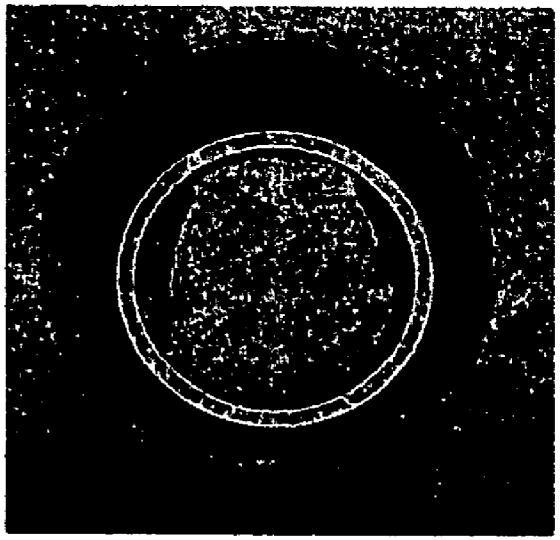
FIG. 2 shows a detergent-non-copourable perfume composition adhered to and covering the entirety of the inner bottom surface of the circumference of a transition component of a package.
Figure 3:
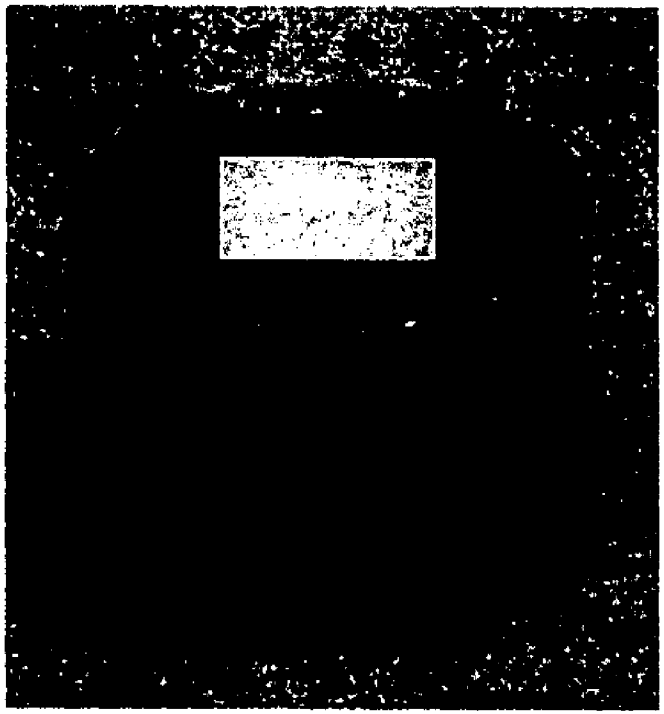
FIG. 3 shows a detergent-non-copourable perfume composition as a rectangle adhered to the interior surface of the spout of the transition component of a package.
Figure 4:
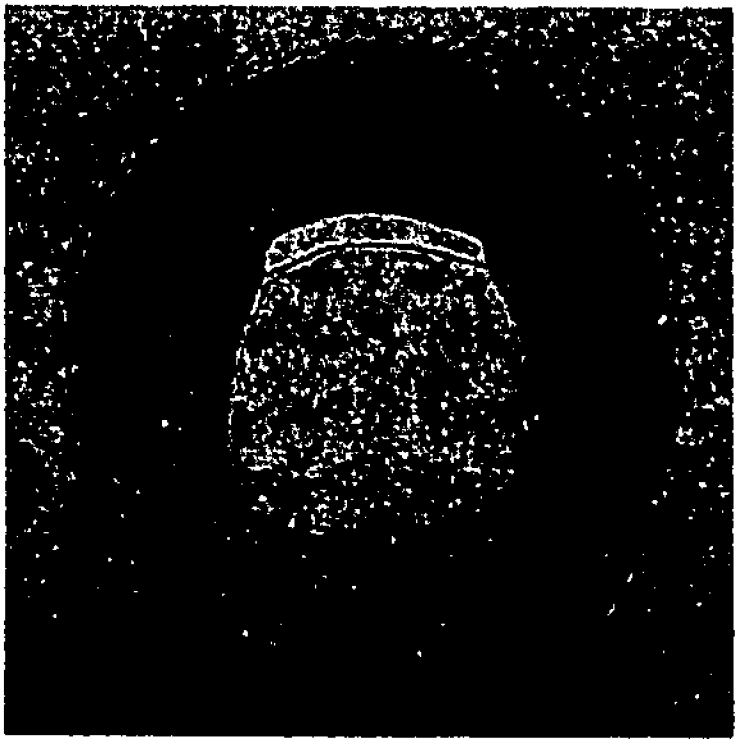
FIG. 4 shows a detergent-non-copourable perfume composition adhered to the bottom interior surface of the spout of the transition component of a package.
Figure 5:
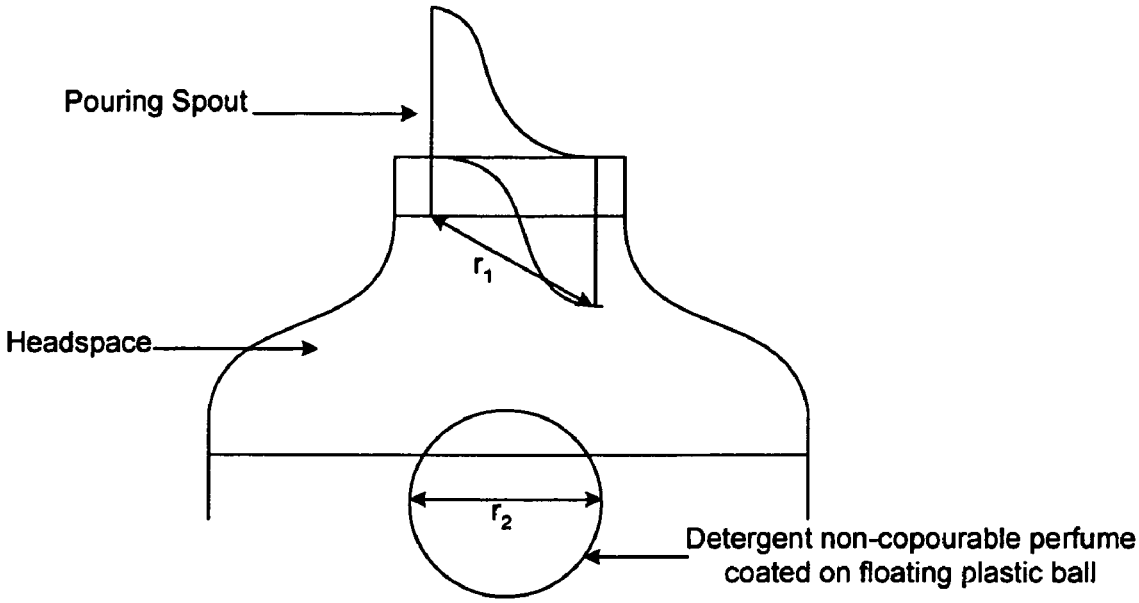
FIG. 5 shows a detergent-non-copourable perfume composition as a solid or hollow floatable sphere wherein the perfume is adsorbed onto or affixed to the surface and the dimension $r_2>r_1$.
Figure 6:
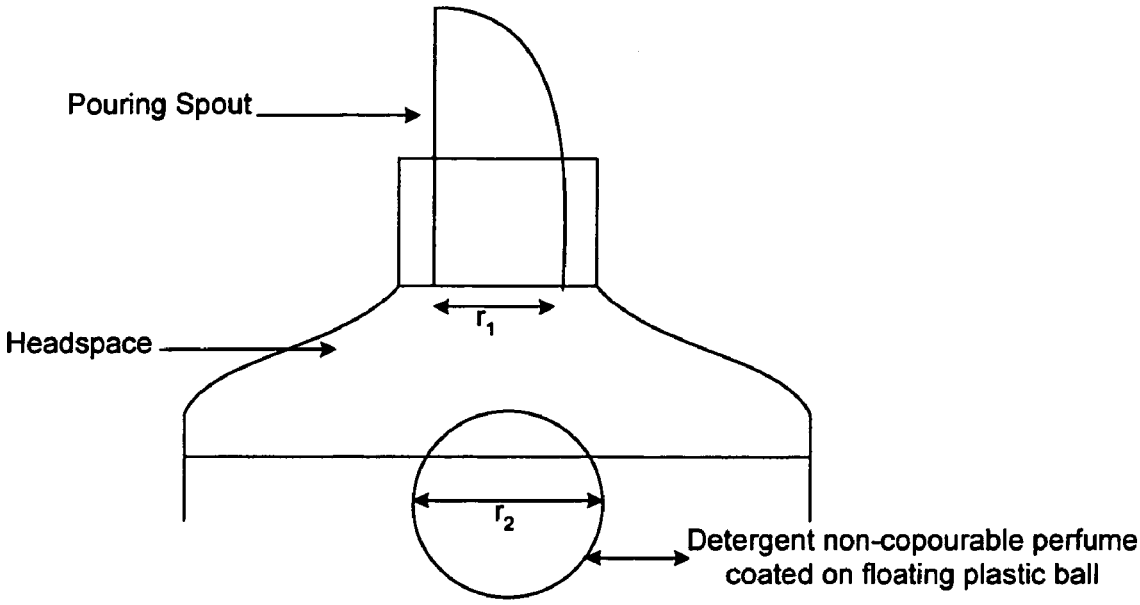
FIG. 6 shows a detergent-non-copourable perfume composition as a solid or hollow floatable sphere wherein the perfume is adsorbed onto or affixed to the surface and the dimension $r_2>r_1$.

All percentages and proportions herein are by weight unless otherwise specifically indicated, e.g., the designation "v/v" after "%" means percentage by volume.

DETAILED DESCRIPTION OF THE INVENTION

One aspect of the invention relates to a laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is selected from:

(1) a detergent-copourable perfume composition;

(2) a fabric care additive;

(3) a laundry-specific detersive additive;

(4) an enzyme;

(5) a volatile malodorous compound; and (6) any combination thereof;

(c) a headspace; and (d) a detergent-non-copourable perfume composition.

In certain embodiments, the laundry detergent product comprises (a) a package comprising (1) a container; and (2) a closure; (b) a fluid laundry detergent pourable at ambient storage temperature and comprising at least one material copourable from the package with the fluid laundry detergent, wherein the material is a detergent-copourable perfume composition; (c) a headspace; and (d) a detergent-non-copourable perfume composition.

In certain embodiments, the laundry detergent product comprises (a) a package comprising (1) a container; and (2) a closure; (b) a fluid laundry detergent pourable at ambient storage temperature and comprising at least one material copourable from the package with the fluid laundry detergent, wherein the material is a fabric care additive, preferably a silicone polymer; (c) a headspace; and (d) a detergent-non-copourable perfume composition.

In certain embodiments, the laundry detergent product comprises (a) a package comprising (1) a container; and (2) a closure; (b) a fluid laundry detergent pourable at ambient storage temperature and comprising at least one material copourable from the package with the fluid laundry detergent, wherein the material is a laundry-specific detersive additive; (c) a headspace; and (d) a detergent-non-copourable perfume composition.

In certain embodiments, the laundry-specific detersive agent is selected from dye transfer inhibitors, optical brighteners, fabric laundering-compatible non-staining dyes, fabric compatible bleaches, laundry soil release polymers, laundry soil suspending polymers, or any combination thereof.

In certain embodiments, the laundry detergent product comprises (a) a package comprising (1) a container; and (2) a closure; (b) a fluid laundry detergent pourable at ambient storage temperature and comprising at least one material copourable from the package with the fluid laundry detergent, wherein the material is an enzyme; (c) a headspace; and (d) a detergent-non-copourable perfume composition.

In certain embodiments, the enzyme is selected from a proteolytic enzyme, a lipolytic enzyme, an amlyolytic enzyme, a cellulolytic enzyme, or any combination thereof. In certain such embodiments, the enzyme comprises at least one protease.

In certain embodiments, the laundry detergent product comprises (a) a package comprising (1) a container; and (2) a closure; (b) a fluid laundry detergent pourable at ambient storage temperature and comprising at least one material copourable from the package with the fluid laundry detergent, wherein the material is a volatile malodorous compound; (c) a headspace; and (d) a detergent-non-copourable perfume composition.

In certain embodiments, the detergent-non-copourable perfume composition is self-adhering. In certain alternative embodiments, the detergent-non-copourable perfume composition further comprises an adhesive for affixing the detergent-non-copourable perfume composition to the package. Additional films or perfume-permeable, detergent-impermeable membranes may optionally be included to further separate the detergent-non-copourable perfume composition, but are not essential to the invention.

Package

One aspect of the invention relates to a laundry detergent product comprising a package comprising (1) a container, typically a bottle, and (2) a closure. In certain embodiments, the package further comprises (3) a transition component, such as a transition collar. Suitable packages may be found in U.S. Pat. No. 4,550,862, U.S. Pat. No. 5,108,009, U.S. Pat. No. 6,398,076, and U.S. Pat. No. 6,659,310, the disclosures of which are incorporated herein in their entirety. Briefly, the disclosure of U.S. Pat. No. 4,550,862 describes a package for liquids comprising (a) a container for housing a liquid and having an upwardly extending finish provided with a dispensing orifice; (b) a transition collar mounted on the exterior of said container finish, said collar having an outwardly projecting pouring spout, a circumscribing wall with fastening means formed on its interior surface, said spout extending above and being spaced from said circumscribing wall to insure maximum dispensing and mess control and drain means for returning spilled liquid to said container; and (c) a measuring cup adapted to serve as a closure, said measuring cup having an open mouth terminating in an anti-drip lip and having fastening means formed on its external surface surrounding said mouth, said external fastening means being adapted to cooperate with the fastening means on said transition collar to attach the measuring cup on the interior of said transition collar with the measuring cup in inverted condition.

The disclosure of U.S. Pat. No. 5,108,009 describes a package comprising a) a container having a mouth cylinder including an outer spiral ridge and an outer locking circumferential ridge disposed above said outer spiral ridge, b) a plug body including a cylindrical wall, a guidepiece for regulating fluid poured out of said container extending vertically from the cylindrical wall within said cylindrical wall, c) said cylindrical wall including at its upper end an outwardly extending collar, d) said plug body including an outer cylinder depending from said cylindrical wall from the outwardly extending collar, e) said plug body outer cylinder including an inner locking ridge, f) said plug body including a sealing ridge protruding slantingly upwardly on an inner peripheral end of the upper surface of the outer collar, g) a cap comprising a top wall, an inner cylindrical circumferential wall, a radially extending cap collar, a cap cylinder depending from said cap collar, an inner spiral ridge disposed on an inner surface of the cap cylinder and a thickened cap wall seal part disposed beneath the cap collar in an outer surface of the cylindrical cap wall, said outer circumferential locking ridge interfitting said inner locking ridge, said plug body sealing ridge contacting elastically said thickened cap wall seal part and said outer spiral ridge engaging said inner spiral ridge when said plug is fitted within the container and said cap is screwed on.

The disclosure of U.S. Pat. No. 6,398,076 describes a fitment and the combination of fitment and bottle and/or closure, particularly for dispensing household products such as heavy duty liquid detergents and fabric softeners. The fitment of the invention comprises an outer circumferential wall which extends upwardly, a connecting web extending inwardly, a downwardly extending inner circumferential wall, a floor extending inwardly from the bottom of the inner circumferential wall, and a pour spout extending upwardly from an inner end of the floor. The inner circumferential wall includes internal fasteners suitable for securing a closure to the fitment. The fitment may be secured to the container finish by complementary fasteners such as internal threads on the fitment and external threads on the finish.

The disclosure of U.S. Pat. No. 6,659,310 describes a product dispensing and drainback fitting for directing the flow of a liquid product from a container and minimizing the occurrence of double pour, said fitting comprising: (a) an outer wall for engagement with the neck of said container; (b) an inner spout centrically positioned within said outer wall; (c) a base extending between said wall and said spout and creating a circumscribing well; (d) a longitudinal slot formed in said inner spout, said longitudinal slot beginning at a point about 30 mm to about 48 mm above said base and extending the remainder of the length of said spout; and (e) a drainback hole formed in said base and aligned with said longitudinal slot, said drainback hole having an area of about 10 $mm^2$ to about 20 $mm^2$.

In certain embodiments when the fluid laundry detergent comprises two or more liquids which are, for example, immiscible, it may be advantageous to use a package as described in U.S. Pat. No. 6,644,511. Briefly, a bottle is described for dispensing a flowable fluid which has a first liquid and a second liquid disposed within a single chamber and which are separated and positioned one above the other. The container includes a bottle base, a bottle body which extends upward from the bottle base to a bottle finish, a fitment having a pouring spout and is arranged on the bottle body at an end opposite the base. The fitment has a first pouring opening from which a first liquid is dispensed and second opening from which a first liquid is dispensed and a second from which a second liquid is dispensed. A diptube is connected to one of the pouring openings projects downward from toward the bottle base. The diptube conveys the liquid on the bottom to a pouring spout while the liquid on the top is conveyed to the pouring spout by the other pouring opening.

In certain embodiments, it may be advantageous to include a vented closure devise. Suitable vented closure devices are described in U.S. Pat. Nos. 6,601,740 and 6,874,656, which are incorporated herein in their entirety by reference. Briefly, U.S. Pat. No. 6,601,740 describes a closure device that has a hollow body with a side opening for liquid, and open end, and a closure end portion, and is slidably engaged in an end-piece screw threadedly engaged on the end part of a neck of a bottle. The closure device seals the bottle when pressed down into the neck until its closure end portion seals against a ridge defining the end mouth of the outlet conduit constituted by the neck and its end-piece. When the device is raised to engage a lower bead in a groove of the end-piece, liquid can be poured out of the bottle by way of the interior of the hollow body and the opening which air enters the bottle by way of an air inlet region and venting passages leading to an air outlet port. An inner barrier to liquid is formed by contact between the widest part of a skirt of the hollow body and the internal surface of the neck. Similarly, U.S. Pat. No. 6,874,656 describes a vented closure for closing and venting a container with threaded engagement to a neck portion of the container for dispensing fluid from the container includes a unitary molded plastic cap constructed and arranged for threaded engagement to the container. The threaded cap defines a septum orifice that is sized and arranged to receive a siphon tube. A gasket is assembled into the threaded cap for sealing the interfit between the vented closure and the container. An elastomeric venting valve is assembled into the threaded cap and the venting valve includes a septum with a slit therein for receiving in a self-sealing manner the siphon tube. A retainer ring is used to capture the venting valve within the threaded cap and a safety ring in unitary combination with the threaded cap retains the vented closure on the container.

In certain embodiments, it may be advantageous to include a drain-back snap-on pour spout closure to equip the container with child safety features. In certain such embodiments, the drain back pour spout fitment has a snap fit structure overlaying a container neck finish and may be secured thereto with adhesives. The snap fit structure includes an outer annular skirt with internal, radial inwardly facing beads engaging a radial outwardly facing surface of the container finish. Spaced from the outer annular skirt by a horizontal upper flange, the spout fitment includes an inner annular skirt with internal threads on the fitment to receive an externally threaded closure. The closure has a plug seal above the threads engaging the upper flange of the fitment and a radial outwardly facing latch engaging a radial inwardly facing interfering projection on the fitment forming a child safety feature for the fitment closure. An example of such a closure may be found in U.S. Pat. No. 6,923,341, the disclosure of which is incorporated herein in its entirety.

Any suitable structural plastic may be used to make the packages. Such structural plastics include, but are not limited to, polyethylene, polypropylene, polyethylene terephthalate, and the like. In certain embodiments, the structural plastic of the package may be transparent as described in U.S. Pat. No. 6,756,350, the disclosure of which is incorporated herein by reference in its entirety. In certain alternative embodiments, the structural plastic may be opaque, or may incorporate structural plastics having differing opacity, e.g., a transparent stripe through which the level of product in the package can be seen, while the remainder of the package is opaque.

In certain embodiments, it may be advantageous to use a stress crack resistant bottle. Suitable examples of such containers can be found in U.S. Pat. No. 6,464,106 and U.S. Pat. No. 6,223,945, the disclosures of which are incorporated in their entirety by reference.

Perfume Composition

The term "perfume", as used herein, includes any odoriferous material, other than malodorous impurities that can be present in technical grades of detergent adjuncts such as surfactants, solvents, and builders. In general, such materials are characterized by a vapor pressure that is less than the atmospheric pressure at ambient temperature. The perfumes employed herein will most often be liquid at ambient temperatures, but may also be solid such as the various camphoraceous perfumes or other sublimable perfumes known in the art. A wide variety of chemicals are known for perfumery uses, including materials such as perfumery aldehydes, ketones, esters, alcohols, terpenes, and the like. Naturally occurring plant and animal oils and exudates comprising complex mixtures of various chemical components are known for use as perfumes, and such materials can be used herein. The perfumes herein can be relatively simple in their composition or can comprise highly sophisticated, complex mixtures of natural and synthetic chemical perfumery components, all chosen to provide any desired odor.

Typical perfumes which can be used in the present invention comprise, for example, woody/earthy bases containing exotic materials such as sandalwood oil, civet, patchouli oil and the like. Other suitable perfumes are for example light, floral fragrances, e.g., rose extract, violet extract and the like. Perfumes can be formulated to provide desirable fruity odors, e.g., lime, lemon, orange, and the like.

In short, any chemically compatible material which emanates a pleasant or otherwise desirable odor may be used as a perfume. Perfume materials are described more fully in S. Arctander, Perfume Flavors and Chemicals. Vols. I and II. Aurthor, Montclair, N.J., and the Merck Index, 13th Edition, Merck & Co., Inc. Rahway, N.J.

The terms "malodor" and "malodorous", as used herein include, but are not limited to, enzyme derived, short-chain fatty acids, or nitrogenous compounds such as amines, polyamines, amine oxide surfactants, amides, alkanolamines, ammonia, or ammonium-containing moieties.

In certain embodiments, perfumes for use herein can be encapsulated or microencapsulated. Encapsulated perfume may be dispersed throughout the polymeric material of the detergent-non-copourable perfume composition.

Alternatively, one or more perfumery compounds which are incorporated in a detergent-copourable perfume composition may be encapsulated. Preferably the encapsulated perfumery compounds that are in the detergent-copourable composition are absent from the detergent-non-copourable perfume composition. In certain embodiments detergent-copourable perfume compositions may be encapsulated while the detergent-non-copourable perfume itself is dispersed throughout a polymeric material such as a low-melting thermoplastic, e.g., a hot-melt adhesive; optionally but preferably in combination with conventional plasticizers and/or tackifiers.

As used herein, "encapsulation" is art-recognized and refers to the formation of a shell which completely surrounds a small amount of the perfume. The shell material may be identical to a polymer composition of the detergent-non-copourable perfume, or may comprise any other ingredient that do not detract from the polymer composition properties both prior to and after rupturing of the shell to release the perfume. Similarly, the perfume may be encapsulated in a shell that itself, along with other capsules, is encapsulated.

In certain embodiments, the detergent-copourable perfume composition has an olfactory character that matches that of the detergent-non-copourable perfume composition. In certain alternative embodiments, the detergent-copourable perfume composition has an olfactory character that is different from that of the detergent-non-copourable perfume composition.

Perfumes are typically composed of many components of different volatility. The detergent-non-copourable perfume composition preferably avoids separation of the components based on their different volatility and allows the sustained delivery of the full perfume bouquet for a long time. In certain preferred embodiments, the perfume is a perfume which is preferably composed by a plurality of components, more preferably by more than 5 components.

Detergent-Non-Copourable Perfume Composition

The laundry detergent product comprises a detergent-non-copourable perfume composition. Suitable detergent-non-copourable perfume compositions for use herein include the polymeric compositions for sustained release of volatile materials described in WO 2005/049717 A2 incorporated herein by reference. Over and above any perfumes or malodors which can enter the headspace by volatilization from the detergent (when such materials are present therein), the detergent-non-copourable perfume composition provides an effective technology for diffusing a perfume throughout the headspace.

In certain embodiments, the release of perfume from the detergent-non-copourable perfume composition is passive.

The term "passive" as used herein is meant to include routes of release of the perfume composition, such as by diffusion, which does not require intervention by the user. In contrast, "active" routes of release require action by the user, including, but not limited to, squeezing of a perfume from a suitable medium, such as a sponge, or by a twisting action, to release the perfume composition. In passive release, preferably, even when subjected to closure or shaking of the package, the rate of release of the perfume composition remains unchanged, i.e., rapid and/or intermittent release of the perfume composition is not the primary mechanism of release.

In certain embodiments, the detergent-non-copourable composition is affixed to an internal portion of the package, provided that when the detergent-non-copourable perfume composition is meltable, the detergent-non-copourable perfume composition has a pouring temperature of at least about 5° C., at least about 10° C., or even at least about 15° C. above the ambient storage temperature.

The detergent-non-copourable perfume composition may be located in the container, the transition component, the closure, or any combination thereof. The detergent-non-copourable perfume composition may be formed into any of various shapes including rings, annular disks, circles, squares, rectangle, or any other shape that is suited to the shape of the space of in which the detergent-non-copourable perfume composition is to be incorporated. In certain embodiments, the detergent-non-copourable perfume composition is located in the transition component of the package, or into an element forming a self-draining dispensing orifice rather than in a cap or closure.

In certain embodiments, the detergent-non-copourable perfume composition is adsorbed onto or affixed to a solid having dimensions larger than the outlet of the package and floatable in the fluid laundry detergent; provided that when the perfume composition is meltable, the pouring temperature thereof is at least 5° C. above the ambient storage temperature. In certain such embodiments, the detergent-non-copourable perfume composition is in the form of a hollow sphere, however, the detergent-non-copourable perfume composition may be in any suitable shape, either hollow or solid, including, but not limited to, a sheet, star, flower, disk, rectangle, square, or any other shape, provided that the detergent-non-copourable perfume composition is dimensioned such that it is larger than the outlet of the package and provided that it is floatable in the fluid laundry detergent. In certain embodiments, it may be advantageous for the package to be transparent and for the detergent-non-copourable perfume composition to be any one of a number of shapes and/or colors. In certain embodiments, the detergent-non-copourable perfume composition may have more than one color. In certain embodiments, the package may contain more than one detergent-non-copourable perfume composition. Moreover, the detergent-non-copourable perfume composition may be directly or indirectly affixed to a component of the package. For example, an indirect affixing method involves having a perfumed hot-melt adhesive set upon a thin plastic film, e.g., of HDPE, which is in turn bonded to a packaging element by means of a separate adhesive material such as an adhesive tape. Thus, the stickiness of the detergent-non-copourable perfume composition is not always critical.

In certain embodiments, the detergent-non-copourable perfume composition comprises a perfume and a polymeric composition, preferably the detergent-non-copourable perfume composition has the ability to release the perfume in a sustained manner, i.e. with a relatively constant release rate and for a long period of time, preferably such that there is still a detectable amount of perfume in the detergent-non-copourable perfume composition when the fluid laundry detergent has been used or only a residual amount of the fluid laundry detergent remains in the container. In certain preferred such embodiments, release of the perfume of the detergent-non-copourable perfume composition is substantially unchanged even when repeatedly contacted with the fluid laundry detergent. In other words, the fluid laundry detergent does not itself extract the perfume from of detergent-non-copourable perfume composition.

Unless otherwise specifically indicated, the phrase "polymeric composition" herein refers to a thermoplastic polymeric composition that can be used to deliver the perfumes in the detergent-non-copourable perfume composition. The term "polymeric composition" as used herein differs from packaging plastics and from polymeric detergent adjuncts. Preferably, a "polymeric composition" has a softening temperature at least about 10° C. below that of packaging plastics used for bottle making, but remains non-pourable at temperatures of up to at least about 35° C. in the absence of added perfume.

In certain embodiments, the perfume of the detergent-non-copourable perfume composition is released by diffusion into the headspace. In certain such embodiments, the detergent-non-copourable perfume composition may optionally be separated from the fluid laundry detergent by a permeable liner element, though such an element is not essential. In certain such embodiments, the liner is permeable to the perfume materials, but impermeable to the fluid laundry composition. In general, the detergent-non-copourable perfume composition can be allowed to come into contact with the fluid laundry detergent.

In general, proportions by weight of detergent-non-copourable perfume composition to fluid laundry detergent can vary widely, e.g., from about 0.01 grams to about 2 grams, more typically from about 0.05 grams to about 0.5 grams of detergent-non-copourable perfume composition are sufficient for perfuming products comprising up to about 3 kg of fluid laundry detergent.

In certain embodiments, the detergent-non-copourable perfume composition comprises from about 1 wt % to about 80 wt % of perfume, preferably from about 10 wt % to about 60 wt %. In certain such embodiments, the balance of the detergent-non-copourable detergent composition comprises thermoplastic polymers, platicizers, tackfiers, or any combination thereof.

When the product as a whole comprises both a detergent-non-copourable perfume composition and a detergent-copourable perfume composition, the copourable composition to perfume in the detergent-non-copourable perfume composition is from about 0:1 to about 1:0.00001.

When the product as a whole comprises both a detergent-non-copourable perfume composition and a detergent-copourable perfume composition and the sum of these is taken as 100% of all perfume in the product, then an effective amount of detergent-non-copourable perfume composition may be as low as about 0.001 wt %, more typically from about 0.01 to about 3 wt % (i.e., up to three hundreths by weight) of all perfume in the product.

In another embodiment, the fluid detergent can be unperfumed and a suitable amount of detergent-non-copourable composition will comprise 100 wt % of all perfume.

In a particularly preferred embodiment, the detergent-copourable perfume composition may comprise up to about 0.1%, preferably up to about 50%, more preferably up to about 100% of fabric substantive perfume raw materials.

In certain embodiments, it may be advantageous to minimize the amount of detergent-copourable perfume which may be susceptible to interaction with other fluid laundry detergent ingredients, for example by having a level of detergent-copourable perfumes of less than about 20%, less than about 10%, or even less than about 1% of the total of perfume in the product. In certain such embodiments, it may be advantageous to encapsulate the detergent-copourable perfumes in a polyamine shell.

Suitable polymeric compositions are capable of effectively delivering a wide variety of perfumes in a broad polarity range, and also preferably adhere well to plastic packaging construction materials such as high density polyethylene, polyethylene terephthalate, polypropylene and the like. Suitable polymeric compositions may further comprise additives which allow the tuning of its polarity characteristics very precisely. This makes it possible to maximize the compatibility with any perfume which could be introduced in the plasticized polymeric matrix thus obtaining a polymeric composition according to the present invention. Without being bound by theory, it is believed that a certain polarity match between the plasticized polymeric matrix and the perfume is required to provide good incorporation and sustained delivery of the perfume.

In certain embodiments, the polymeric composition may be formed into a material selected from a film, a sheet, a foam, or an adhesive. In certain preferred such embodiments, the polymeric composition is formed into an adhesive, preferably a solidified hot-melt adhesive.

In certain embodiments, the detergent-non-copourable perfume composition is a solidified hot-melt adhesive that further comprises at least one plasticizer, at least one tackifier, or any combination thereof.

In certain embodiments, the detergent-non-copourable perfume composition is insoluble in the fluid laundry detergent.

The detergent-non-copourable perfume composition may be affixed to the package using any suitable method. In certain such embodiments, the surface of the package to which the detergent-non-copourable perfume composition is affixed is first subjected to localized roughing. Methods for such localized roughing are well known in the art, e.g., by abrasion of an otherwise smooth packaging plastic.

In certain embodiments, suitable polymeric compositions can be formulated as hot-melt adhesives that have a low application temperature, preferably below about 100° C. and in some cases below about 70° C. This is a particularly desirable property for materials used to incorporate perfumes as the higher is the processing temperature, the greater is the risk of losing by evaporation significant amounts of the perfume incorporated during the manufacturing of the composition. Moreover, higher application or processing temperatures may increase safety hazards associated with processing of the polymeric compositions. Examples of suitable hot-melt adhesives may be found in U.S. Pat. No. 6,084,010 and U.S. Pat. No. 5,827,913, the disclosures of which are incorporated herein by reference in their entirety.

The solidified perfumed hot-melt adhesive may be produced by processing a thermoplastic resin with perfumes to form a homogeneous mixture at process temperatures less than about 85° C. In certain such embodiments, the thermoplastic resin is added to a fluid comprising perfume. Accordingly, a method for producing a solidified perfumed hot-melt adhesive comprises processing a thermoplastic resin with perfumes to form a homogeneous mixture at process temperatures less than about 85° C. In certain embodiments, the method comprises processing the thermoplastic resin by adding it to a fluid comprising perfume.

In certain embodiments, the polymeric composition comprises a) a copolymer of ethylene with at least another monomer comprising at least one heteroatom; and b) more than 10% of a plasticizer comprising at least a heteroatom. Such compositions may be formed into films, sheets, foams, and adhesives, preferably adhesives, more preferably hot-melt adhesives. These hot-melt adhesive compositions preferably have good adhesion on most substrates (plastic films, foams, cardboard, and the like).

Suitable copolymers may be block or non-block copolymers, grafted copolymers, copolymers with side chains, or crosslinks, or copolymers where ethylene monomers are randomly copolymerized with monomers comprising at least one heteroatom.

Suitable copolymers of ethylene are, for example, ethylene-vinyl ester copolymers, ethylene-acrylic ester copolymers, ethylene-methacrylic ester copolymers, ethylene-acrylic acid copolymers and their salts, ethylene-methacrylic acid copolymers and their salts, ethylene-vinyl ester-acrylic acid copolymers, ethylene-vinyl ester-methacrylic acid copolymers, ethylene-vinyl ester-maleic anhydride copolymers, ethylene-acrylic ester-maleic anhydride copolymers, ethylene-vinyl ester-glycidyl methacrylate copolymers, ethylene-acrylic ester-glycidyl methacrylate copolymers, ethylene-maleic anhydride copolymers, ethylene-glycidyl methacrylate copolymers The monomer comprising at least one heteroatom in the copolymers preferably represents from 10% to 90% of the total weight of the copolymer, more preferably at least 14% most preferably at least 18%.

Particularly preferred copolymers are ethylene-vinyl acetate copolymers such as those sold under the trade names Elvax™ by Dupont, Evathane™ by Atofina, Escorene™ by Exxon and Levapren™ and Levamelt™ by Bayer and ethylene-acrylic ester copolymers such as those sold under the trade name Lotryl™ by Atofina.

The term "monomer comprising at least a heteroatom" includes all those monomers which comprise at least a C—X linkage in the molecule wherein X is not C or H. Said C—X linkage is preferably a polar linkage. Preferably the carbon atom is linked to an N, S, F, Cl, or O atom. More preferably said polar linkage is part of a carbonyl group and, more preferably, of an ester group. Preferred monomers comprising at least a heteroatom for the present invention are vinyl acetate, vinyl alcohol, methyl acrylate, ethyl acrylate, butyl acrylate, acrylic acid and salts formed therefrom, methacrylic acid and salts formed therefrom, maleic anhydride, glycidyl methacrylate and carbon monoxide.

A second component for the polymeric compositions of the present invention is a plasticizer or blend of plasticizers comprising at least one heteroatom, which plasticizer or blend of plasticizers is compatible with the copolymer of ethylene with at least another monomer comprising at least a heteroatom. The term "plasticizer comprising at least a heteroatom" includes all those plasticizers which comprise at least a C—X linkage in the molecule wherein X is not C or H. Said C—X linkage is preferably a polar linkage. Preferably the carbon atom is linked to an N, S, F, Cl, or O atom. More preferably said polar linkage is part of a carbonyl group and, more preferably, of an ester group.

Suitable plasticizers for use in the polymeric compositions according to the present invention are described in WO 2005/049717 A2 incorporated herein by reference in its entirety and include citric acid esters, low molecular weight polyesters, polyethers, liquid rosin esters, aromatic sulfonamides, phthalates, benzoates, sucrose esters, derivatives of polyfunctional alcohols (where polyfunctional means having 2 or more hydroxyl groups), adipates, tartrates, sebacates, esters of phosphoric acid, fatty acids and diacids, fatty alcohols and diols, epoxidized vegetable oils etc and mixtures thereof. As already mentioned above, the different polarity of the different compatible plasticisers (measurable with any method known to those skilled in the art, for example water/octanol partition coefficient) can be used to tune the polarity of the polymeric matrix in order to provide a better match with the polarity of the perfume.

The polymeric compositions of the present invention preferably are thermoplastic polymeric compositions. These can be manufactured by using any known process for manufacturing thermoplastic polymeric compositions and will typically comprise melting the polymer and then homogeneously blending the plasticizer and the perfume to form a homogeneous mass that is then cooled to obtain the polymeric composition. Among thermoplastic compositions preferred are those which have low melt temperature and viscosity and therefore may be processed as hot melts. In these hot-melt systems, the loss of perfume upon blending, as well as upon subsequent application in the molten state, is minimized.

Other optional components which can be preferably used when the polymeric composition according to the present invention is a thermoplastic composition and preferably is suitable for use as a perfumed hot-melt adhesive, are tackifying resins such as rosin derivatives, aliphatic resins, aromatic resins or mixed aliphatic-aromatic resins in order to further increase the adhesion capacity of the compositions of the present invention. Further optional ingredients such as other polymers or copolymers, fillers, crosslinkers, pigments, dyes, antioxidants and other stabilizers, etc can also be added to provide desired properties to the composition.

The polymeric compositions may also be prepared using a polymer solution, either as an intermediate or final step. Preparations of this type are well known to those skilled in the art and typically will comprise the steps of dissolving the selected polymer, plasticizer, and perfume in an effective solvent, and heating if necessary to prepare a solution or a gel. The solvent can then be eliminated by evaporation, thereby providing the polymer composition containing the perfume dispersed therein.

Alternatively, the polymeric compositions may be prepared in the form of an aqueous emulsion or dispersion. The techniques for obtaining aqueous emulsions or dispersions of polymers are well known to one of skill in the art. For example, the selected polymer, plasticizer, and perfume can be blended together as a thermoplastic material. The resulting melt can then be dispersed in water, preferably at a temperature above its melting point, by mixing and surfactant and/or stabilizing systems known to those skilled in the art can be employed to stabilize the resultant emulsion or dispersion.

In certain alternative embodiments, a preformed aqueous polymeric dispersion or emulsion can be blended with the selected plasticizer and perfume. This can be accomplished by adding the ingredients directly to the polymeric dispersion or emulsion, or e.g. by forming an aqueous dispersion of the perfume and plasticizer and blending this with the polymeric dispersion or emulsion. Both procedures result in the formation of an aqueous dispersion of a polymeric composition. Water can be then eliminated by evaporation.

Alternatively, the copolymer can be directly formed in a water dispersion in the presence of the plasticizer and/or of the perfume. This process may involve the solution or dispersion of monomers or prepolymers in water that contains the dispersed perfume and/or plasticizer followed by initiation to form the polymeric dispersion. If required, the perfume or plasticizer can be alternatively added subsequently to produce a dispersed polymeric composition.

The polymeric compositions due to their rheology and their adhesion properties are particularly useful to be applied in the molten state onto a selected substrate, and directly adhered thereto. They can be applied, for example, to the inner surface of a container in a suitable position in order to suitably modify the headspace in the container by releasing the perfume to create a perfumed headspace. Such release is "passive", i.e., it requires no human intervention or physical displacement. In certain embodiments, application to the inner surface of the container may be done during the manufacturing of the container. The polymeric composition may be applied using any suitable hot melt delivery system. These systems typically include a melting unit, which maintains the hot melt at a temperature that will provide a material of processable viscosity. The melting unit typically contains a pumping system capable of pumping the hot melt through a hose until it reaches the glue gun, or nozzle. The nozzle can have different geometries according to the desired application form of the glue (coatings, stripes, beads etc). In a typical embodiment, a slot nozzle can be used as the glue gun.

The term "substantially soluble" as applied to a material such as the detergent-non-copourable perfume composition or a preferred perfumed hot melt adhesive composition herein, means that at least about 80%, preferably at least about 90% of the total amount of material referred to is soluble in the total amount of fluid laundry detergent present in the container.

Olfactory Character of the Detergent-Non-Copourable Perfume Composition

In certain embodiments, it is advantageous for the neat product odor (NPO) of the fluid laundry detergent to have a good "clean/fresh laundry" olfactory connotation that is distinct, for example, from a "fine fragrance" olfactory connotation. It is believed that this is due to the fact that consumers are likely to expect that the NPO of the products should act as a predictor for the expected smell of their laundry that has been washed with the product. In other words, the selection of olfactory character must, in the consumer's mind, match the desired end use.

Therefore it is preferred that the detergent-non-copourable perfume herein should be formulated as a laundry perfume, focusing on volatile perfume raw materials (PRMs) and less on PRMs termed "residual" or "enduring" in the art. (The reverse being true for the detergent copourable perfume compositions further described hereinafter).

Suitable PRMs for use in the detergent-non-copourable perfume include, but are not limited to: aldehydic such as methylnonyl acetaldehyde, decyl aldehyde, or lauric aldehyde; floral such as PT bucinal, hexylcinnamic aldehyde, hexyl salicylate, benzyl acetate, or peonile; citrus such as orange oil, lemon oil, lemonile, gernyl nitrile, or dihydromyrcenol; fruity such as frutene or floracetate; green such as undecavertol, methylphenylcarbinyl actetate, beta gamma hexenol, or triplal; woody such as iso E super, methyl cedrylone, or patchouli; or musky such as habanolide or galaxolide.

Moreover, because the detergent-non-copourable perfume tends to "cover" the full product odor, it is preferred that the detergent-non-copourable perfume should itself comprise a fully formulated perfume as distinct from a simpler "accord" that blends with the product odor.

The term "substantially insoluble" as applied to a material such as the detergent-non-copourable perfume composition or a preferred perfumed hot melt adhesive composition herein, means that less than about 20%, preferably less than about 10% of the total amount of material referred to is soluble in the total amount of fluid laundry detergent present in the container.

A "residual amount" as used herein is meant to include up to about 5% of the original amount by weight, preferably up to about 3%, more preferably up to about 1%.

Fluid Laundry Detergent

The present products comprise a fluid laundry detergent. Typically the amount of the fluid laundry detergent is in accordance with the proportions by weight provided hereinabove in defining the detergent-non-copourable perfume composition. The fluid detergent is typically provided in volumes of 1 liter, 1½ liter, 3 liter, or 5 liter in packages having sufficient internal capacity when fully loaded with the detergent to still have a headspace volume of at least about one milliliter, or even at least 5 milliliter.

In certain embodiments the fluid laundry detergents herein are pourable liquids or gels. Such detergents can have varying viscosities provided that they remain pourable. Suitable viscosities, measurement of viscosity, and thickeners/structurants are described in WO 05/012475, WO 05/059077 and WO 05/026303 which are incorporated herein by reference in their entirety. Briefly, the viscosity can be quantified by specifying a viscosity under a specified constant low stress as measured using, for example, a Carrimed CLS 100 Viscometer with a 40 mm stainless steel parallel plate having a gap of 500 microns. Unless indicated explicitly to the contrary, throughout the specification all stated viscosities are suitably measured at a shear rate of 21 $s^{-1}$ and at a temperature of 25° C.

Suitable fluid laundry detergents may be structured or isotropic. They may be internally structured, using a surfactant, or externally structured, using a thickener. They may have one or more phases which flow together. Fluid laundry detergents preferably comprise at least about 90% by weight of a single fluid phase and are simple pourable liquids or pourable gels. Fluid laundry detergents herein thus preferably range from a pourable liquid to a pourable gel as characterized by viscosity.

In certain embodiments, the fluid laundry detergent composition is a pourable liquid, preferably having a viscosity of less than about 1,500 mPa, less than about 1,000 mPa, or even less than about 500 mPa.

In certain embodiments, the fluid laundry detergent composition is a pourable gel, preferably having a viscosity of from about 1,500 mPa to about 6,000 mPa, about 1,500 mPa to about 4,000 mPa, about 1,500 mPa to about 3,000 mPa, or even about 1,500 mPa to about 2,000 mPa.

Suitable fluid laundry detergents comprise at least one material copourable from the package with the balance of surfactants and/or builders and/or carriers. The material is selected from (1) detergent-copourable perfume compositions, (2) fabric care additives; (3) laundry-specific detersive additives; (4) enzymes suitable for fabric laundering; (5) volatile malororous compounds or (6) any combination thereof.

(1) Detergent-Copourable Perfume Composition

Suitable fluid laundry detergents herein include those comprising a detergent-copourable perfume composition. The detergent-copourable perfume composition can range in form and may be a perfume oil or a perfume emulsion, or can be a mixture comprising both a perfume oil and microparticles or microencapsulates of perfumery materials.

Suitable levels of detergent-copourable perfume composition comprise from about 0.0001 to about 10 wt % of the fluid detergent composition, from about 0.001 to about 2 wt %, or even from about 0.001 to about 1 wt %. In certain embodiments, the detergent-copourable perfume composition comprises from 0.01% to about 1% of perfume microcapsules and/or amine-assisted or other highly fabric substantive perfumes.

In certain embodiments it may be advantageous for the detergent-copourable perfume composition to be fully mixed into the fluid laundry detergent to provide a solution, dispersion, or suspension. In certain such embodiments, a thickener may be used to improve storage stability. Preferred detergent-copourable perfume compositions comprise known perfumery materials, including pro-fragrances or pro-perfumes which are known in the art; see for example WO 00/00580, incorporated herein in its entirety by reference, which describes a beta-ketoester profragrance with ethoxylated polyalkyleneimine and WO 99/46318, incorporated herein in its entirety by reference, which describes a silicone profragrance.

Fully formulated perfumes, as distinct from simple accords or single perfumery compounds, are preferred. In certain embodiments the detergent-copourable perfume composition comprises a mixture of a liquid perfume formulation together with perfume microcapsules. Moreover, when using perfume microcapsules or amine-assisted perfume delivery, the invention includes embodiments in which no conventional liquid perfume formulations are added to the fluid detergent.

Perfume microcapsules herein are any encapsulated perfumes having the form of discrete particles having sizes sufficiently small to be dispersed or suspended in the fluid laundry detergent compositions herein, so that they are pourable from the package along with the laundry detergent composition. "Encapsulated" means that there will generally be present one or more coating layers enclosing the perfume. The perfume contained in the encapsulate can be in liquid or solid form and can be homogeneously or non-homogeneously distributed. Suitable particle sizes range from nanometer scale to micron scale and even to millimeter scale. Typical particle sizes range from 1 micron to 1 mm. In embodiments herein, encapsulated perfume leaves little or no visible residues on fabrics onto which it is deposited.

In preferred embodiments perfume microcapsules have a measurable increase in deposition onto fabrics during laundering with the detergent, by virtue of chemical and/or physical mechanisms ranging from having a particle size suitable for being entrapped in fabrics by filtration, through to electrostatic attraction to (typically negatively charged) fabrics by virtue of having opposite net surface charge. In other preferred embodiments, the perfume microcapsules are those which adhere to fabrics by virtue of tackiness, more specifically, having a work of adhesion consistent with tacky particles.

Suitable encapsulated or microencapsulated perfumes, i.e., perfume microcapsules, are described in U.S. 2004/0072719, U.S. Pat. No. 6,225,372, U.S. Pat. No. 6,359,031, U.S. Pat. No. 4,234,627, U.S. Pat. No. 3,516,941, U.S. Pat. No. 6,916,780, U.S. Pat. No. 4,919,841, U.S. Pat. No. 5,281,356, U.S. Pat. No. 5,281,357, U.S. Pat. No. 5,281,355 and under Fragrance Encapsulation in Kirk Othmer's Encyclopedia of Chemical Technology, which are incorporated herein by reference in their entirety. Suitable encapsulation systems include, but are not limited to waxes, aminoplasts, and emulsion polymerized systems. Coatings may be cationic or non-charged. In encapsulating perfumes for use in the detergent-copourable perfume composition, it is preferred both to (i) reduce or limit diffusion of perfume into the detergent and (ii) to enhance the fabric substantivity of the perfume, suitably as taught, for example, in Example 7 of the hereinbefore-referenced U.S. 2004/0072719 A1 which makes use of a specific cationic coating applied to perfume-loaded melamine-formaldehyde capsule slurries commercially available from Celesscence International Ltd. Uniformly sized particles can be made by processes such as that described in U.S. Pat. No. 6,890,592, incorporated herein by reference in its entirety.

In other embodiments the detergent-copourable perfume composition comprises a mixture of a liquid perfume formulation together with an amino or polyamino-functional compound, which is optionally premixed with the liquid perfume. Such uses of polyamino or polyimine compounds to enhance fabric deposition of perfumes herein are collectively referred to as involving an "amine-assisted perfume delivery matrix", or in alternate terms, "amine-assisted perfume".

An amine-assisted perfume or perfume delivery system herein includes any perfumery compound or mixture of perfumery compounds having improved deposition on fabrics when laundered in the presence of the fluid detergent, by virtue of a chemical and/or physical interaction between the perfumery compound or mixture of perfumery compounds and an organic amine or polyamine. The amine or polyamine can be added to the detergent separately from, or together with, perfumery compounds. Preferably the amine or polyamine is not in the form of a premix with perfumery compounds, it is added separately to the detergent. The amine or polyamine preferably comprises at least one, more preferably a plurality of, primary and/or secondary amine moieties. In preferred embodiments comprising amine-assisted perfumes or amine- or polyamine-assisted perfume delivery systems, the amine has a low vapor pressure and little or no inherent odor, for example having a normal boiling point of at least 200 deg. C, and is preferably an involatile polymeric amine which comprises at least one ionizable non-amine moiety which is anionic at a pH of greater than 8 in a 10% aqueous solution. Amine-assisted perfumes herein generally comprise no enzymatic proteins as the essential polymeric aminofunctional perfume deposition enhancing material of such embodiments. Moreover amine-assisted perfumes herein generally comprise at most very low levels, preferably less than 1 ppb, of malodorous low-boiling amine impurities, e.g., trimethylamine. In embodiments herein, the amine-assisted perfume leaves little or no visible residues on fabrics onto which it is deposited.

In embodiments of the invention comprising amine-assisted perfume delivery and/or perfume microcapsules, at least about 0.001 weight fraction (a thousandth by weight) of the detergent-copourable perfume composition is incorporated into an polyamine-assisted delivery matrix, a perfume microcapsule, or any combination thereof. Amine or polyamine assisted perfume systems for use as, or as part of, the detergent-copourable perfume composition are disclosed in the following patent documents, incorporated herein by reference in their entirety: U.S. 2003211960, U.S. 2003073607, U.S. 2004097397, U.S. 2003228992, U.S. 2003211963, U.S. 2004116320, U.S. 2005009727, U.S. 2005043205, U.S. Pat. No. 6,451,751, U.S. Pat. No. 6,511,948, U.S. Pat. No. 6,699,823, U.S. Pat. No. 6,790,815, U.S. 2005043208, U.S. Pat. No. 6,740,713, U.S. Pat. No. 6,764,986, WO 01/04084, and EP 1067117, which are incorporated herein in their entirety.

Suitable perfumery compounds for formulation of the detergent-copourable perfume composition, especially for embodiments which are at least partially capable of deposition on fabrics so as to secure improved wet and/or dry fabric odor (perfumery compounds described as "enduring perfume" in U.S. Pat. No. 5,780,404 which is incorporated by reference in its entirety) include, but are not limited to, benzophenone, benzyl acetate, benzyl acetone, citronellol, citronellyl esters (acetate, formate, propionate), cis-3-hexenol, dimethyl benzyl carbinyl acetate, damascones (alpha, beta, delta), damascenone, damascenone total, eugenol, geraniol, geranyl esters (acetate, formate, propionate, butyrate, tiglate, phenyl acetate), geranyl nitrile, hexylcinnamic aldehyde, ionones (alpha, beta, AB, gamma methyl), linalool, lauric aldehyde, linalyl acetate, lilial, methyl dihydrojasmonate, nerol, phenyl ethyl acetate, phenyl ethyl esters (formate, acetate, isobutyrate, isovalerate, phenyl acetate), phenyl hexanol, OTBCA, PTBCA, rosalva, tetrahydrolinalool, undecylenic aldehyde, amylcinnamic aldehyde, amyl salicylate, anisic aldehyde, anethol, aurantiol, benzyl alcohol, benzyl esters (butyrate, acetate, propionate, salicylate, benzoate), cis-jasmone, dihydroisojasmonate, flor acetate, frutene, gamma decalactone, helional, hydroxycitronellal, indol, nonalactone, methyl benzoate, methyl anthranilate, jasmolactone, undecalactone, cymal, dimethylbenzyl carbinol, floralozone, florhydral, lyral, mayol, majantol, mugetanol, oncidal, tetrahydromuguol, cis-3-hexenyl acetate, neobutenone, galaxolide, terpineol, heliotropin, vanillin, dihydromyrcenol, beta methyl naphtyl ketone, citronellyl nitrile, decyl aldehyde, mandaril, myrcenyl actetate, myrcene, methylnonyl acetaldehyde, methyl octyl acetaldehyde, nonyl aldehyde, octyl aldehyde, octyl alcohol, tetrahydro myrcenol, terpinyl acetate, alpha pinene, beta pinene, camphene, dipentene, eucalyptol, fenchyl acetate, fenchyl alcohol, terpinolene, carvone, methyl chavicol, methyl amyl ketone, methyl hexyl ketone, methyl salicylate, coumarin, iso E Super, vertofix, iso gamma super, ambrox, cetalox, bacdanol, sanjinol, dartanol, javanol, cashmeran, caryophyllene, hydroxyambran, irone, isobutyl quinoline, lorysia, LRG 201, methyl cedrylone, ambrocenide, karanal, norlimbanol, orivone, polysantol, nirvanol, cis-3-hexenyl salicylate, diphenyl oxide, ligustral, methyl heptine carbonate, methyl octine carbonate, methyl phenyl carbinyl acetate, calone, floralozone, allyl amyl glycolate, allyl caproate, allyl cyclohxyl propionate, allyl heptoate, amyl acetate, amyl propionate, benzaldehyde, dodecalactone, ethyl acetate, ethyl acetoacetate, ethyl methylphenyl glycidate, ethyl-2-methyl propionate, ethyl-2-methyl butyrate, ethyl maltol, maltol, ethyl vanillin, ambrettolide, cashmeran, ethylene brassylate, exaltolide, muscenone delta, isoeugenol, tonalide, musk ketone, exaltex, exaltolide, indol, musk xylol, musk plus.

Other suitable perfumes for use in certain embodiments of detergent-copourable perfumes include perfumes having relatively high vapor pressures, specifically those having boiling points of greater than about 260° C.; high hydrophobicity, specifically those having ClogP(Octanol/Water) of greater than about 3.0; and low odor detection thresholds, specifically less than about 50 ppb; see U.S. Pat. No. 6,458,754; WO 99/55819 A; EP 1073705B, which are incorporated herein by reference in their entirety.

(2) Fabric Care Additives

Fluid laundry detergents herein include embodiments comprising fabric care additives. Suitable levels of fabric care additive in such embodiments are from about 0.0001% to about 20% by weight of the fluid laundry detergent, more typically from about 0.1% to about 5 wt %. As distinct from detersive additives, which have some cleaning properties, fabric care additives are materials which help retain or improve fabric properties and/or fabric comfort properties, especially of colored fabrics. Fabric care additives include, but are not limited to, fabric shape retention aids, fabric softeners or conditioners, antistatic agents, humectants, fabric skin feel improvers, wrinkle reducers, antipilling agents, dye fixatives, and the like.

Suitable fabric care additives include, but are not limited to cationic fabric softener agents (such as a quaternary ammonium fabric-softening agent,), cationic gums such as cationic hydroxyethylcellulose, silicone polymers or copolymers such as aminosilicones commercially available from General Electric, Dow Corning and other suppliers, chlorine scavengers, polyethylene microbeads, dye fixatives such as polyvinylpyridine N-oxide, dye transfer inhibitors, or any combination thereof.

In certain embodiments, the fluid laundry detergents comprise a dye fixative material. Suitable dye fixatives are described on page 35 of WO 00/27958 which is incorporated by reference and are commercially marketed by Ciba and Clariant.

In certain embodiments, the fluid laundry detergent comprises a silicone polymer or a blend of silicones, e.g., a blend comprising at least one aminofunctional silicone. Suitable aminofunctional silicones are described, for example, in WO 05/007790, WO 04/046452, WO 04/042136, WO 04041987, and WO 04/041912 which are incorporated by reference in their entirety. Coacervate phase forming polymers may be added, as described in WO 04/041983. Other suitable aminosilicones may be used, such materials being commercially available from Dow Corning, Wacker Chemie and other suppliers. Silicone copolymers or blends thereof, especially those containing non-yellowing aminosilicones, can improve fabric softness, provide silky feel, and improve shape retention.

In certain embodiments, the fluid laundry detergent comprises a cationic silicone polymer. Suitable cationic silicone polymers are described, for example, in U.S. Pat. No. 6,903,061, which is incorporated in its entirety by reference. In certain such embodiments, the cationic silicone polymer comprises one or more polysiloxane units, preferably polydimethylsiloxane units of formula $—\{(CH_3)_2SiO\}_n—$ having a degree of polymerization, n, of from 50 to 200 and organosilicon-free units comprising at least one diquaternary unit. In certain preferred embodiments, the selected cationic silicone polymer has from 0.50 to 1.0 weight fraction of said organosilicon-free units selected from N,N,N',N'-tetramethyl-1,6-hexanediammonium units.

The selected cationic silicone polymer can also contain from 0.0 to 0.20 weight fraction, in certain embodiments a non-zero amount, of the total of organosilicon-free units of —$NHCH(CH_3)CH_2O(AO)_aCH_2CH(CH_3)NH$— units wherein AO represents ethyleneoxy, propyleneoxy, butyleneoxy and mixtures thereof and a is from 5 to 70.

The selected cationic silicone polymer can also contain from 0.0, in certain embodiments a non-zero amount to 0.20 weight fraction, of the total of organosilicon-free units of —$NR_3^+$ wherein R is alkyl, hydroxyalkyl or phenyl. These units can be thought of as end-caps.

Moreover the selected cationic silicone polymer generally contains anions, selected from inorganic and organic anions, more preferably selected from saturated and unsaturated $C_1$-$C_{20}$ carboxylates and mixtures thereof, to balance the charge of the quaternary moieties, thus the cationic silicone polymer also comprises such anions in a quaternary charge-balancing proportion.

Conceptually, the selected cationic silicone polymers herein can helpfully be thought of as non-crosslinked or "linear" block copolymers including non-fabric-substantive but surface energy modifying "loops" made up of the polysiloxane units, and fabric-substantive "hooks".

In certain embodiments, the fluid laundry detergent may comprise a polymeric dye transfer inhibiting agent. Polymeric dye transfer inhibiting agents are known in the art for reducing or preventing dye-transfer during the laundering process. Polymeric dye transfer inhibiting agents useful herein include polyvinylpyrrolidone and copolymers thereof.

In certain alternative embodiments, the fluid laundry detergent may comprise, as a fabric care additive, a quaternary ammonium fabric-softening agent. In certain such embodiments, the compositions contain from about 0.1 to about 10%, from about 1% to about 10%, from about 1% to about 4%, or from about 1.5% to about 3%, by weight of the composition, of a quaternary ammonium fabric-softening agent having the general formula:

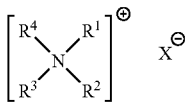

wherein $R^1$ and $R^2$ are individually selected from the group consisting of $C_1$-$C_4$ alkyl, $C_1$-$C_4$ hydroxy alkyl, benzyl, and —$(C_2H_4O)_xH$ where x has a value from about 2 to about 5; X is an anion; and (1) $R^3$ and $R^4$ are each a $C_8$-$C_{14}$ alkyl or (2) $R^3$ is a $C_8$-$C_{22}$ alkyl and $R^4$ is selected from the group consisting of $C_1$-$C_{10}$ alkyl, $C_1$-$C_{10}$ hydroxy alkyl, benzyl, and —$(C_2H_4O)_xH$ where x has a value from about 2 to about 5.

In certain embodiments, the quaternary ammonium fabric-softening agent is selected from the mono-long chain alkyl quaternary ammonium surfactants wherein in the above formula $R^1$, $R^2$, and $R^3$ are each methyl and $R^4$ is $C_8$-$C_{18}$ alkyl.

In certain embodiments, the quaternary ammonium surfactants are selected from the chloride, bromide and methylsulfate $C_{8-16}$ alkyl trimethyl ammonium salts, and $C_{8-16}$ alkyl di(hydroxyethyl)-methyl ammonium salts. Of the above, lauryl trimethyl ammonium chloride, myristyl trimethyl ammonium chloride and coconut trimethylammonium chloride and methylsulfate are particularly preferred. ADOGEN 412™, a lauryl trimethyl ammonium chloride commercially available from Witco, is a preferred softening agent.

In certain embodiments, the quaternary ammonium surfactants are selected from the di-$C_8$-$C_{14}$ alkyl dimethyl ammonium chloride or methylsulfates; particularly preferred is di-$C_{12}$-$C_{14}$ alkyl dimethyl ammonium chloride. This class of materials is particularly suited to providing antistatic benefits to fabrics.

In one embodiment the quaternary ammonium softening agent contains less than 10 ppm of trimethylamine and/or dimethylamine impurities, more preferably less than 2 ppm.

In certain embodiments, the weight ratio of detersive agent to quaternary ammonium softening agent in the fluid laundry detergent is from about 3:1 to about 20:1.

In certain embodiments, the fluid detergent compositions of the present invention include a chlorine scavenger as a fabric care additive. As used herein, the term "chlorine scavenger" refers to any compound or material that is capable of de-activating free chlorine ($Cl_2$ and/or hypochlorite) in solution or at the fabric/solution interface. De-activation can take place either by direct reduction of chlorine species by the chlorine scavenger, such as to chloride, or by combination of the chlorine scavenger with a chlorine species to yield a less oxidizing species for dyes or chlorine bleach-sensitive textile fibers than free chlorine. Such less oxidizing species include for example chlorine adducts, e.g., chloramines when the chlorine scavenger contains an amino nitrogen moiety. Chlorine scavengers useful herein typically contain a moiety that is readily halogenated, e.g., a trivalent nitrogen, or another non-nitrogen electron-rich site or moiety which is readily susceptible to attack by chlorine or hypochlorite. Chlorine scavengers useful herein include nonpolymeric types which tend to be the most rapidly reacting, and polymeric types, which may be preferred since they are known to not be associated with odors. Suitable chlorine scavenger may be nitrogen-containing or nitrogen-free.

The compositions may contain from about 0.1% to about 20%, more preferably from about 0.1% to about 10%, more preferably from about 1% to about 10%, more preferably from about 1.5% to about 5%, by weight of the composition, of the chlorine scavenger. The level selected is preferably that which adequately eliminates (or nearly eliminates) ambient chlorine levels in the water supply. The actual amount of chlorine scavenger needed will vary based on the molecule selected, the extent of the wash water carryover to the rinse, product dosage, and level of residual chlorine in the rinse water. In certain embodiments, mixtures of more than one chlorine scavenger may be used.

(3) Laundry-Specific Detersive Additives

In certain embodiments, the fluid laundry detergent comprises a laundry-specific detersive additive. Suitable levels of laundry-specific detersive additive in such embodiments are from about 0.0001% to about 20% by weight of the fluid laundry detergent.

Such laundry-specific detersive additives as used herein are those compounds other than surfactants, builders or enzymes which have properties useful primarily in laundry cleaning or end-result as distinct from fabric care, and which are less suitable for other cleaning compositions such as shampoos, toilet bowl cleaners and the like. Optical brighteners are an example of such an additive. Other laundry-specific detersive additives include laundry soil release polymers, laundry soil-suspending polymers such as those selected from alkkoxylated polyalkyleneimines and their derivatives, and the like. Commercial polymeric laundry-specific detersive additives are available from BASF, Rohm & Haas, Nippon Shokubai and other suppliers.

(4) Enzymes Suitable for Fabric Laundering

In certain embodiments, the fluid laundry detergent comprises at least one enzyme. The appropriate of enzyme can, for example, be in the range of from about 0.001 to about 1 wt %, or higher if desired. The amount of enzyme depends primarily on the particular enzyme used; such enzyme preparations can comprise varying amounts of active enzyme. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or combinations thereof. Other types of enzymes may also be included. They may be of any suitable origin, such as vegetable, animal, bacterial, fungal and yeast origin. Their choice is generally governed by several factors including pH-activity and/or stability optima, thermostability, stability versus active detergents, builders and so on. A preferred enzyme combination comprises a cocktail of conventional detersive enzymes like protease, lipase, cutinase and/or cellulase in conjunction with amylase. Detersive enzymes are described in greater detail in U.S. Pat. No. 6,579,839, which is incorporated herein by reference in its entirety. In certain embodiments, fluid laundry detergents contain from about 0.001% to about 5% by weight in total of two or more detersive enzymes, preferably from about 0.01 to about 1% by weight.

Suitable proteases include subtilisins from *Bacillus* (e.g. *subtilis, lentus, licheniformis, amyloliquefaciens* (BPN, BPN'), *alcalophilus*,) such as Esperase®, Alcalase®, Everlase® and Savinase® (Novozymes), BLAP, and variants thereof. Other suitable proteases are described in EP130756, WO91/06637, WO95/10591 and WO99/20726, which are incorporated herein by reference in their entirety.

Suitable amylases (α and/or β) are described in WO 94/02597 and WO 96/23873 and are incorporated by reference in their entirety. Suitable commercially available examples of amylases are Purafect Ox Am® and Termamyl®, Natalase®, Ban®, Fungamyl® and Duramyl®. Amylases also include, for example, α-amylases described in British Patent Specification No. 1,296,839.

Suitable cellulases include both bacterial or fungal cellulase. Preferably, they will have a pH optimum of between 5 and 9.5 and include bacterial or fungal cellulases, e.g. produced by *Humicola insolens*, particularly DSM 1800, e.g. 50 Kda and ~43 kD [Carezyme®]. Other suitable cellulases are the EGIII cellulases from *Trichoderma longibrachiatum*. Suitable cellulases are also disclosed in U.S. Pat. No. 4,435,307, which is incorporated by reference in its entirety.

Suitable lipases include those produced by *Pseudomonas* and *Chromobacter* groups. The LIPOLASE enzyme derived from *Humicola lanuginosa* and commercially available from Novo. Other suitable lipases include e.g., Lipolase Ultra®, Lipoprime® and Lipex® from Novozymes. Also suitable are cutinases [EC 3.1.1.50] and esterases. See also lipases in Japanese Patent Application 53,20487, available from Areario Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Diosynth Co., The Netherlands, and lipases ex *Pseudomonas gladioli*.

Suitable carbohydrases useful herein include e.g. mannanase (disclosed, for example, in U.S. Pat. No. 6,060,299), pectate lyase (for example, those disclosed in PCT Application WO99/27083), cyclomaltodextringlucanotransferase (for example, those disclosed in PCT Application WO96/33267), and xyloglucanase (for example, those disclosed in PCT Application WO99/02663).

Bleaching enzymes useful herein with enhancers include e.g. peroxidases, laccases, oxygenases, (e.g. catechol 1,2 dioxygenase, lipoxygenase (for example, those disclosed in PCT Application WO 95/26393), and (non-heme) haloperoxidases.

A wide range of enzyme materials and means for their incorporation into synthetic detergent compositions are disclosed in U.S. Pat. No. 3,553,139, U.S. Pat. No. 4,101,457, U.S. Pat. No. 4,507,219, and U.S. Pat. No. 4,261,868 which are incorporated by reference in their entirety.

In certain embodiments, the enzyme is selected from a proteolytic enzyme, a lipolytic enzyme, an amlyolytic enzyme, a cellulolytic enzyme, or any combination thereof. In certain such embodiments, the enzyme comprises at least one protease.

In certain embodiments, the fluid laundry detergent may itself contain perfumes. In certain such embodiments, these perfumes may be enzyme destabilizing and are selected from aldehydes, ketones, and/or terpenes. These perfume materials may be present at elevated levels in the detergent-non-copourable perfume composition relative to the levels of these materials in the detergent-copourable perfume composition.

In certain embodiments, the enzyme-destabilizing perfume raw materials are incorporated preferentially in the detergent-non-copourable perfume composition and their level in the fluid laundry detergent is proportionately reduced. In other words, the majority of the total amount of enzyme-destabilizing perfume raw materials in the laundry detergent product is incorporated into the detergent-non-copourable perfume composition rather than in the detergent copourable perfume composition.

In certain embodiments, when at least one enzyme is included in the fluid laundry detergent, the composition may further comprise an enzyme stabilizer. Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl)serine salts; (meth)acrylic acid-(meth)acrylic acid ester copolymer and PEG; lignin compound, polyamide oligomer, glycolic acid or its salts; poly hexa methylene bi guanide or N,N-bis-3-amino-propyl-dodecyl amine or salt; and mixtures thereof. Typically detergents, comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water.

It is to be understood that the foregoing levels of calcium and/or magnesium ions are sufficient to provide enzyme stability, however, more calcium and/or magnesium ions may be added to the compositions to provide an additional measure of grease removal performance. Accordingly, fluid laundry detergents comprise from about 0.05% to about 2% by weight of a water-soluble source of calcium or magnesium ions, or both. The amount may vary, of course, with the amount and type of enzyme employed in the composition.

In an embodiment of the invention, the detergent-non-copourable perfume composition comprises enzyme destabilizing perfumery aldehydes, ketones and/or terpenes at a level of at least 0.005%, more preferably at least 3%, and at a level ratio of at least about 1:0.1, preferably about 1:0.001, and most preferably about 1:0.00001 to the levels of these materials in the detergent-copourable perfume composition.

(5) Volatile Malororous Compounds

In certain embodiments, it may be advantageous to use a lower cost detersive agent and certain of these detersive agents may be malodorous impurities such as low levels of trimethylamine, sulfur compounds, fatty materials having some degree of rancidity, branched-chain fatty compounds and the like. Levels of impurity can vary widely, for example trimethylamine can be detectable by odor at part per billion levels, whereas less volatile malorodous impurities may be present at levels of up to 1% or more in the fluid detergent before they can be detected by odor. Detergent ingredients which often comprise volatile malodorous compounds include alkylbenzenesulfonic acids and their derivatives, fatty acids and their derivatives including those derived from rapeseed and from certain synthetic alcohols having low levels of branching; solvents including alkanolamines; and certain aminofunctional compounds such as alkyltrimethylammonium halides subject to beta-eliminations, Hoffman degradation reactions and the like often with production of volatile olefinic impurities. Moreover volatile malororous compounds are often more readily perceptible in certain pH ranges for fluid laundry detergents, such ranges generally being from about 5 to about 12, more typically from about 6 to about 9.

In certain embodiments that comprise a low cost ingredients, the fluid laundry detergent further comprises a perfume, while in certain alternative embodiments, the fluid laundry detergent does not include a perfume.

Other Adjuncts

Fluid laundry detergents herein generally comprise conventional detersive surfactants, at levels of from about 1 to about 80 wt. %, preferably from about 5 to about 50 wt. %. Detersive surfactants may be of anionic, nonionic, zwitterionic, amphoteric or cationic or any compatible mixtures thereof. Preferred surfactants include anionic surfactants and mixtures of anionic and nonionic surfactants, or mixtures of anionic surfactant having no nonionic surfactant such as mixtures of alkylpolyethoxysulfates and alkylbenzenesulfonates lacking nonionic surfactant and thickened with "viscosity enhancing agents", more specifically sodium carbonate and/or sodium chloride all as disclosed in U.S. Pat. No. 6,730,650 incorporated herein by reference in its entirety. In certain embodiments, it is preferred that the fluid laundry detergents herein have a hydrophilic index, HIc, of from about 8 to 9.2 as defined and disclosed in WO 00/27958A1, incorporated by reference in its entirety. Without intending to be limited by theory, such hydrophilic index improves compatibility of the detergent-non-copourable perfume composition and the fluid laundry detergent. More generally, suitable detergent surfactants are described in U.S. Pat. No. 5,466,802, U.S. Pat. No. 3,664,961, U.S. Pat. No. 3,919,678, U.S. Pat. No. 4,222,905, and in U.S. Pat. No. 4,239,659, the disclosures of which are incorporated by reference in their entirety.

In certain embodiments, the fluid laundry detergent comprises up to about 90 wt % of one or more detersive surfactants, detersive builders, enzyme stabilizers, suds suppressors, chelating agents, opacifiers, thickeners, pigments or any combination thereof.

Anionic surfactants which are suitable for use herein include the water-soluble salts, preferably the alkali metal, ammonium and alkylammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ethanolamine alkyl sulfates, especially those obtained by sulfating the higher alcohols ($C_8$-$C_{18}$ carbon atoms) such as those produced by reducing the glycerides of tallow or coconut oil; b) the sodium, potassium and ethanolamine alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383, which are incorporated by reference in their entirety. Especially valuable are linear straight chain alkylbenzene sulfonates in which the average number of carbon atoms in the alkyl group is from about 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol. Additional suitable nonionic surfactants include polyhydroxy fatty acid amides of the formula

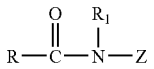

wherein R is a $C_{9-17}$ alkyl or alkenyl, $R^1$ is a methyl group and Z is glycityl derived from a reduced sugar or alkoxylated derivative thereof. Suitable examples include N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference in their entirety.

In addition to the anionic and nonionic surfactants described, the compositions of the present invention may also contain cationic, amphoteric, or zwitterionic surfactants, typically added to improve surfactancy. Preferred cationic surfactants include amine oxides, for example, $C_8$-$C_{16}$ alkyl dimethylamine N-oxides, or amino functional surfactants.

Mixtures of surfactants, such as LAS (linear alkyl benzene sulfonate) in combination with a co-surfactant such as ethoxylated alkyl sulfate (such as AES) and/or nonionic surfactant are preferably used herein.

Suitable surfactants for fluid laundry detergents include, but are not limited to anionic surfactants, nonionic surfactants, cationic surfactants, zwitterionic surfactants and mixtures thereof. Suitable builders for fluid laundry detergents include water-soluble builders and water-insoluble builders. Water-soluble detersive builders are preferred. Suitable enzymes for fabric laundering include proteases, amylases, cellulases, lipases and mixtures thereof; enzyme stabilizers (such as propylene glycol, boric acid and/or borax) may also be used. Other conventional materials suitable for use in the fluid laundry detergents herein include opacifiers, suds suppressors, chelating agents, fabric-safe oxidants or bleaches, antioxidants, light stabilizers, antibacterial agents, or any combination thereof.

The liquid detergent compositions according to the present invention also contain an aqueous carrier; in certain embodiments the carrier may be thickened or non-thickened, and in certain embodiments the carrier may further include a conventional hydrotrope Generally the amount of the aqueous carrier employed in the compositions herein will be relatively large. Preferably, the compositions of the present invention comprise from about 40% to about 80% of an aqueous liquid carrier. The most cost effective type of aqueous, non-surface active liquid carrier is, of course, water itself. Accordingly, the aqueous, non-surface active liquid carrier component will generally be mostly, if not completely, comprised of water. Other water-miscible carriers, such as alkanols, diols, polyols, ethers, amines, alkanolamines, and similar solvents may be added to fluid detergent compositions as co-solvents or stabilizers. Accordingly, the aqueous liquid carrier component of the liquid detergent products herein, including organic solvents if present, will generally comprise water present in concentrations ranging from about 30% to 93%, more preferably from about 35% to about 50%, by weight of the composition. In certain embodiments, the level of any non-water solvent will be minimized, e.g., not more than about 10%, preferably not more than about 5%, more preferably not more than about 1% of non-water solvents will be present in the fluid laundry detergents.

In certain embodiments, fluid laundry detergents comprise a detergent builder material which serves to counteract the effects of calcium, or other ion, water hardness encountered during laundering/bleaching use of the compositions herein. Suitable detergent builders are described in U.S. Pat. No. 4,321,165, incorporated herein by reference in its entirety. Examples of such materials include, but are not limited to, the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids $C_{10}$-$C_{22}$ fatty acids and citric acid. Other examples are organic phosphonate type sequestering agents such as those which have been sold by Monsanto under the Dequest tradename and alkanehydroxy phosphonates. Citrate salts and $C_{12}$-$C_{18}$ fatty acid soaps are highly preferred. A particularly preferred builder is citric acid.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

If utilized, the composition may comprise up to 30%, preferably from about 1% to about 20%, more preferably from abut 3% to about 10%, by weight of the composition, of the organic builder materials. While all manner of detergent builders known in the art can be used in the detergent compositions of the present invention, the type and level of builder should be selected such that the final composition has an initial pH of from about 7.0 to about 9.0 at a concentration of from about 1% to about 10% by weight in water at 20° C.

Other embodiments are possible within the spirit and scope of the invention. Such embodiments include products having a cap or over-cap which can be used as a measuring device. It is possible to include a separate portion of detergent-non-copourable perfume composition which is affixed to such a measuring device. It is furthermore possible for the invention to include multi-compartment, e.g., dual compartment, bottles, with the detergent-non-copourable perfume composition present to perfume the headspace of one or both compartments. It is possible to use the invention in conjunction with fluid laundry detergent products which are fully transparent, hazy or opaque, e.g., as a result of incorporating an opacifier or pearlescent agent, or in cases where the fluid detergent is inherently hazy. It is moreover possible to use the invention in conjunction with fluid laundry detergent products comprising more than one fluid phase, such as a so-called "split phase" fluid.

The term "ambient storage temperature" as used herein is in the range from about 0° C. to about 50° C., preferably from about 5° C. to about 40° C., more preferably from about 10° C. to about 30° C., suitably about 25° C.

The term "copourable" as used herein means that the material referred to pours out of the package along with the fluid laundry detergent at ambient temperature. Examples of copourable materials include those which are soluble in, or suspendable in, the fluid laundry detergent. Preferred copourable perfumes include perfumes that are emulsifiable in the liquid detergent, soluble in the liquid detergent, or suspendable as small particles (e.g., having size from nanometer-scale to about 2 millimeters) in the composition as determined at ambient storage temperature.

The term "fluid" as used herein is meant to include compositions that are pourable at ambient temperature. Such compositions include, but are not limited to, liquids and gels.

The term "headspace" as used herein refers to an accessible headspace and is meant to include the vapor located above the fluid laundry detergent in a package or container that enables the odor of the contents of the package or container to be detected by the user. Preferably the headspace is located in the package at a location that suitable for olfactory sampling by a consumer on opening the closure of the package. A typical headspace volume is from 5% to 10%, suitably 8% v/v (volume/volume)—in other words, a package suitably comprises 92% by volume of fluid detergent and 8% headspace by volume.

The term "tackifier" or "tackifier resin" herein is as used in the art of adhesives, more specifically hot-melt adhesives. See U.S. Pat. No. 4,623,698. A tackifier is optionally added when making the detergent-non-copourable perfume composition, in order to improve its tackiness. Tackifiers are available commercially from suppliers such as Dupont under the ELVAX tradename or from Eastman under the FORALYN tradename.

Example 1

24 bottles of fluid laundry detergent product sold commercially in the United Kingdom as Bold 2 in 1 Ocean Clear are purchased from a supermarket. According to the label, these bottles each provide 20 standard washes and contain 1.5 liter of fluid laundry detergent. Each bottle is identified on the underside as being manufactured from high density polyethylene as structural plastic. The bottles each have a volume of headspace that is at least 50 milliliters, this headspace being located directly above the fluid laundry detergent. A transition collar, also confirmed to be manufactured of high density polyethylene, comprising an integrated pouring spout, the transition collar being similar to that described in U.S. Pat. No. 4,550,862 incorporated herein by reference, is affixed to the top of each bottle and a male threaded closure is screwed into each transition collar/pouring spout.

The closures are removed and the detergent poured out. The transition collars are pried off. The closures, bottles and transition collars are thoroughly washed several times by hand, and are dried in a vacuum oven. The bottles, closures and transition collars are judged odorless by a panel of three perfumers.

The underside of each transition collar is slightly roughened using a tool made by bending a plastic nail file.

Using a spatula, a detergent-noncopourable perfume composition according to Table 1, Col. A, is applied at 75 deg. C (soft viscous honey-like consistency) to the roughened underside portion of each transition collar, forming an annular patch having a surface area of approximately 2.3 $cm^2$ and an estimated thickness of about 1 to 1.5 mm. The weight of detergent-noncopourable perfume composition applied to each transition collar is 0.2 g. and the detergent-noncopourable perfume composition comprises 0.1 g of the perfume of Table 2, i.e., the perfume level as a percentage of the detergent-noncopourable perfume composition therefore being 50 wt. %.

The transition collars loaded with detergent-noncopourable perfume composition are pressed back in place on the bottles.

The bottles are filled with fluid detergent formulas of Table 3, Col. B, that includes the detergent-copourable perfume composition of Table 4. The closures are reaffixed, completing the preparation of a laundry detergent product according to the invention.

The above constitutes a first embodiment. Further embodiments in accordance with the invention and preparable from the compositions of additional columns in Tables 1 and 3. The invention includes embodiments from any combination of the compositions given in Tables 1-5.

TABLE 1

Detergent-non-copourable perfume composition

| | A - Wt. % | B - Wt % | C - Wt % | D - Wt % |
|---|---|---|---|---|
| Elvax 250 | 20% | 20 | 25 | 20 |
| Elvax 40W | 10% | 10 | 10 | 40 |
| Foralyn 5020F | 20% | 10 | 5 | 30 |
| Perfume of Table 2 | 50% | 60 | 70 | 10 |

TABLE 2

Perfume for Detergent-non-copourable perfume composition

| | Wt % |
|---|---|
| Benzyl Acetone | 0.20 |
| Geranyl Acetate | 0.20 |
| Vanillin | 0.20 |
| Undecylenic Aldehyde | 0.40 |
| Coumarin | 0.60 |
| Ligustral | 0.60 |
| Iso Bornyl Acetate | 0.80 |
| Decyl Aldehyde | 1.00 |
| Diphenyl Oxide | 1.00 |
| Eugenol | 1.00 |
| Undecalactone | 1.00 |
| Para Cymene | 1.10 |
| Geraniol | 1.90 |
| Geranyl Nitrile | 1.90 |
| Linalool | 2.30 |
| Terpineolene | 2.90 |
| Citronellol | 3.80 |
| Habanolide | 3.80 |
| Vertofix | 3.80 |
| Linalyl Acetate | 4.80 |
| P.t. bucinal | 5.70 |
| Flor Acetate | 7.60 |
| Frutene | 7.60 |
| Hexyl Cinnamic Aldehyde | 7.60 |
| Hexyl Salicylate | 9.60 |
| Orange Oil Cold Pressed | 13.30 |
| Dihydro Myrcenol | 15.30 |
| | 100.00 |

TABLE 3

| | A - Wt. % | B - Wt. % | C - Wt. % | D- Wt. % | E - Wt. % | F - Wt. % |
|---|---|---|---|---|---|---|
| Fluid laundry detergents | | | | | | |
| Detergent-copourable perfume composition 1 (Perfume composition of Table 4) | 0.1 | 0.65 | 0 | 0.3 | 0.4 | 0.7 |
| Detergent-copourable perfume composition 2 Part A: (Perfume of Table 5) | 0.2 | 0.3 | 0 | 0 | 0 | 0 |
| Part B: Polyethyleneimine perfume carrier (Lupasol HF ex BASF) - in mixing the overall formula, add separately from Part A | 0.1 | 0.1 | 0 | 0 | 0 | 0 |

TABLE 3-continued

| | A - Wt. % | B - Wt. % | C - Wt. % | D- Wt. % | E - Wt. % | F - Wt. % |
|---|---|---|---|---|---|---|
| Fabric care additives | | | | | | |
| Smectite clay (1-10 micron impalpable white Ca montmorillonite ex Sud-Chemie or Southern Clay Co.) | 3.0 | 3.3 | 0 | 0 | 0 | 0 |
| Polyamine N-oxide e.g., poly(2-vinylpyridine)-N-oxide as described in U.S. Pat. No. 5,633,225 | 0 | 0 | 0 | 0.3 | 0. | 0 |
| Aminosilicone ex. General Electric Bayer Silicones as WARO TP | 0 | 0 | 0 | 0 | 0.8 | 0 |
| C12 akyldimethylhydroxyethylammonium chloride | 0 | 0 | 0 | 0 | 1.0 | 0 |
| Cationic hydroxyethylcellulose | 0 | 0 | 0 | 0 | 0.1 | 0 |
| Polyvinylpyrrolidone (PVP) or PVP/VI ex. BASF, International Specialty Products, or Reilly Industries per U.S. Pat. No. 6,391,995 | 0 | 0 | 0 | 0.3 | 0 | 0 |
| Laundry-specific detersive additives | | | | | | |
| Optical Brightener ex. Ciba | 0.14 | 0.14 | 0.03 | 0.2 | 0 | 0.2 |
| hexamethylenediamine, ethoxylated to 24 EO/NH, dimethyl quat, tetrasulfate | 0 | 0 | 0 | 0 | 1.8 | 1 |
| Enzymes | | | | | | |
| Protease (40.60 mg.g) | 0.4 | 0.5 | 0 | 0 | 0.4 | 0.7 |
| Amylase (43.76 mg/g) | 0.1 | 0.1 | 0 | 0 | 0.1 | 0.2 |
| Enzyme Stabilizers | | | | | | |
| Na- or monoethanolammonium metaborate | 1.3 | 1.3 | 0 | 1 | 1.5 | 2.4 |
| Volatile malodorous compounds | | | | | | |
| Trimethylamine | <500 ppb | <1000 ppb | <500 ppb | <500 ppb | <500 ppb | <500 ppb |
| Fatty odor | No | Yes | No | Yes | No | No |
| Surfactants | | | | | | |
| C11.8 LAS, acid form | 16.0 | 16.0 | 1 | 0 | 0 | 12 |
| Na lauryl ether sulfate, 3 EO | 0 | 0 | 4 | 10 | 0 | 0 |
| C12/C14 EO 7 or C45 EO 8 nonionic | 2.0 | 2.0 | 0 | 14 | 11 | 10 |
| C12-alkyl dimethylamine | 0 | 0 | 0 | 0 | 2 | 0 |

TABLE 3-continued

| | A - Wt. % | B - Wt. % | C - Wt. % | D- Wt. % | E - Wt. % | F - Wt. % |
|---|---|---|---|---|---|---|
| N-oxide | | | | | | |
| Builders | | | | | | |
| Citric acid | 2.5 | 2.5 | 0 | 0 | 3 | 4 |
| C12/C18 topped palm kernel fatty acid | 11.5 | 7.3 | 0 | 0 | 0 | 4 |
| Rapeseed fatty acid | 0 | 4.1 | 0 | 8.0 | 0 | 0 |
| Suds suppressors | | | | | | |
| Silicone suds suppressor ex Dow Corning | 0.2 | 0.2 | 0 | 0 | 0 | 0 |
| Silicone emulsion ex Dow Corning | 0.1 | 0.1 | 0 | 0 | 0.05 | 0.05 |
| Structurants/ Viscosity enhancers | | | | | | |
| Hydrogenated Castor Oil | 0.2 | 0.2 | 0 | 0 | 0.4 | 0.4 |
| Ionic viscosity increaser (Na carbonate/Na chloride) per U.S. Pat. No. 6,730,650, or common salt | 0 | 0 | 3.5 + 1.25 | 2.0 | 0 | 0 |
| Solvents/ Hydrotropes | | | | | | |
| 1,2-propanediol | 9.0 | 8.0 | 0 | 4 | 3 | 2 |
| Ethanol | 0 | 0.8 | 0 | 0 | 0.4 | 1.4 |
| Diethylene glycol | 0 | 0 | 0 | 0 | 0 | 2 |
| Monoethanolamine | 0 | 0 | 0 | 0 | 0 | 1 |
| Na cumene sulfonate | 2.0 | 2.0 | 0 | 0 | 0 | 2 |
| Other | | | | | | |
| Chelant (Diethylenetriaminepentaacetic acid, Na salt) or phosphonate equivalent | 0 | 1.5 | 0.08 | 1.0 | 0.25 | 0.3 |
| Fabric-compatible nonstaining dye ex. Ciba or Milliken | 0.005 | 0.003 | 0.001 | 0.004 | 0.003 | 0.001 |
| Balance to 100% | Water | Water | Water | Water | Water | Water |

TABLE 4

| Detergent-copourable perfume composition 1 for Table 3 | Wt. % |
|---|---|
| Ambrox | 0.500 |
| Benzyl Acetone | 0.100 |
| Beta Naphthol Methyl Ether | 0.100 |
| Citronellol | 2.000 |
| Coumarin | 0.300 |
| Decyl Aldehyde | 0.500 |
| Dihydro Myrcenol | 2.000 |
| Diphenyl Oxide | 0.500 |
| Dipropylene Glycol | 7.000 |
| Eugenol | 0.500 |
| Flor Acetate | 7.000 |
| Frutene | 7.000 |
| Geraniol | 1.000 |
| Geranyl Acetate | 0.100 |
| Geranyl Nitrile | 1.000 |
| Habanolide | 5.000 |
| Hexyl Cinnamic Aldehyde | 15.200 |

TABLE 4-continued

| Detergent-copourable perfume composition 1 for Table 3 | Wt. % |
|---|---|
| Hexyl Salicylate | 21.300 |
| Iso Bornyl Acetate | 0.400 |
| Ligustral | 0.300 |
| Linalool | 1.200 |
| Linalyl Acetate | 2.500 |
| Lymolene | 6.000 |
| Methyl Cedrylone | 4.000 |
| Orange Oil Cold Pressed | 7.000 |
| P.t. bucinal | 4.600 |
| Para Cymene | 0.600 |
| Terpineolene | 1.500 |
| Undecalactone | 0.500 |
| Undecylenic Aldehyde | 0.200 |
| Vanillin | 0.100 |
| | 100.000 |

TABLE 5

| Detergent-copourable perfume composition 2 for Table 3 | |
|---|---|
| | Wt. % |
| Dynascone | 0.05 |
| Delta Damascone | 0.10 |
| Ambrofix | 0.10 |
| Ambrettolide | 0.20 |
| Hydroxyambran | 0.35 |
| Decyl Aldehyde | 1.15 |
| Undecalactone | 2.30 |
| Peonile | 2.50 |
| Lauric Aldehyde | 2.85 |
| Ionone Gamma Methyl | 3.00 |
| Cashmeran | 3.50 |
| Fenchyl Acetate | 4.50 |
| Iso Bornyl Acetate | 5.60 |
| Habanolide 100% | 6.80 |
| Methyl Nonyl Acetaldehyde | 8.00 |
| Iso E Super | 17.00 |
| Hexyl Salicylate | 17.00 |
| Dihydro Myrcenol | 25.00 |
| | 100.00 |

Example 2

The procedure of Example 1 is followed except that the Bold 2 in 1 product is replaced by "Tide with a touch of Downy" sold in the United States. The packages are marked "100 Fluid Ounce (3.12 Qt.) or 2.95 liters. The headspace volume is 8% v/v (volume/volume).

Example 3

The procedure of Example 1, embodiment A is followed except that the detergent-copourable perfume composition of Table 4 is omitted and the Lupasol HF of Table 3 is omitted.

Example 4

A detergent-non-copourable perfume composition comprises the following ingredients not including label-making materials:

30% ELVAX (=Polymer) ex Dupont

15% Foralyn 5020 (=Liquid Plasticizer) ex Eastman

5% Kristalex (=Solid plasticizer) ex Eastman

50% Perfume wherein the perfume is the perfume of Table 2 in Example 1.

Preparation of Melt

Procedures are carried out in a fume hood. Add solid pellets of ELVAX and Kristalex to an aluminum cup. Add Foralyn to the mixture. Put the cup on a hot plate. Set the temperature at 200° C. The pellets melt in 5-10 minutes. Stir vigorously with a spatula to render the mixture homogenous.

Then place the homogeneous mixture in its cup on a second hot plate set at 100 deg. C. Start adding perfume. A slight excess, e.g., 3-4%, of perfume over the target amount is used so as to compensate for slight perfume losses due to evaporation. Add few drops of perfume at a time into the cup. If smoky vapors arise, lower the hotplate setting slightly, corresponding to e.g., 5° C. If mixture doesn't become homogenous and no smoky vapors are observed, one can use another hot plate having a higher temperature setting to rapidly increase the temperature of the mixture in order to make it homogenous. Continue mixing until all the perfume is absorbed forming a melt, and the melt has become homogeneous.

Making Labels Loaded with Detergent-Non-Copourable Perfume Composition

Label-making materials and apparatus are as follows:

Polyester Film (Efflegid 1-H Pat. No. 100)

Silicone non-stick Sheet (General Electric Silicones H180)

Sticky tape (Regular stick double-sided adhesive tape with a width of 2.56 cm ex. 3M Health Care)

Pasta machine (Marcato Atlas Pastabike, Model 150 mm-Deluxe, Reg design no; 1048534)

The concept involved in this experiment is to prepare detergent-non-copourable perfume composition initially in the form of a sandwich structure comprising the following successive layers: double-sided adhesive tape with protection layer on one side; polyester film; solidified perfumed hot-melt, non-stick silicone sheet. Such a structure can be cut to any suitable size and affixed to a packaging component such as a transition collar by simply removing the protection layer from the sticky tape, contacting the sandwich with the packaging element, and finally, removing the silicone non-stick sheet to expose the perfumed surface of the solidified hot-melt.

Take a length of polyester film and one of non-stick sheet. Feed them face-to-face into the pasta machine at a setting of 7 while pouring the melt prepared under "preparation of melt" between the film and the sheet. This results in a length of material which is cut to any suitable size (see below). Wastage typically includes 4 cm at the beginning and end of the production, together with 1 cm at each side of the structure. In the wastage area, the thickness of perfumed hot-melt is not uniform.

Application on Component of the Package

If one wishes to add in total a specified mass e.g., 0.2 g, of hot melt onto a transition piece or transition collar of a liquid laundry detergent bottle, it is required to know the amount of solidified melt per unit area (gram/$m^2$) that has been prepared in the pasta strip-making.

To determine the amount per unit area, one works with the product from the pasta machine having discarded wastage. Cut a piece of solidified melt. Determine its area by measuring with a ruler and its mass by weighing on any suitable balance and subtracting the mass of the covering films which is known. Convert units to $m^2$ and grams, respectively. Calculate amount of solidified melt per unit area (gram/$m^2$). This quantity is abbreviated as "gsm". Repeat the determination using several (e.g., 3-5) samples of solidified melt. Uniform results are obtained.

If, for example, 0.2 g of hot melt is needed for providing a detergent-non-copourable perfume composition on a package, e.g., a transition collar of a liquid laundry detergent bottle, divide the calculated "gsm" by 0.2. Multiplying this number by $10^4$ results in the surface (in $cm^2$), that must be cut out of the solidified perfumed melt strip and put on the substrate, e.g., transition collar.

Example 5

Formulation of Nonpourable Perfume Composition

Ingredients

20% ELVAX 250

10% ELVAX 40W

20% Foralyn 5020F

50% Perfume

Preparation of the Mixture

Add the solid pellets of the ELVAX 250 and the ELVAX 40W to an aluminum cup, also adding the Foralyn 5020F to the mix. This mix is then put on a hot plate. The temperature of the hot-plate is preset at 200° C. After waiting 5-10 minutes, when the pellets are melted, the mix is stirred vigorously to make it homogenous, using a spatula. Once the mixture is homogenous, it is allowed to stand in its cup on the hotplate without mixing for a few seconds.

Then the mixture in its cup is transferred to a second hot plate where the temperature is preset at 100° C.

Start adding the perfume. Add a few drops of perfume at a time into the cup. If smoky vapors, arise the temperature is reduced by a few degrees by lifting the cup. If mixture doesn't become homogenous and no smoky vapors are observed, one can use another hotplate preset at slightly higher temperature to increase temperature of the mixture so as to make it homogenous.

Continue mixing until all the perfume is absorbed into the melt and the melt has become homogeneous.

Application on the Bottle

While the mixture still warm and liquid, take the amount needed with a clean spatula and directly apply a uniform layer on the surface of a transition collar or pouring spout.

If needed the package surface to be coated can be treated using sandpaper to increase the adhesion.

Then let the package surface, e.g., transition collar, cool to ambient temperature of 25° C.

Example 6

A product is prepared following the method of Example 1 with the following modifications: The Detergent non-copourable perfume composition of Table 1, Column A is prepared, replacing the Perfume of Table 2 by the perfume of Table 7. The fluid laundry detergent of Table 3, Column B is used, except that the detergent-copourable perfume composition 1 is replaced by the perfume composition of Table 6, rather than that of Table 4.

TABLE 6

| co-pourable perfume | |
|---|---|
| Material Name | Wt % |
| Ambrox | 0.50 |
| Benzyl Acetone | 0.10 |
| Beta Naphthol Methyl Ether | 0.10 |
| Citronellol | 2.00 |
| Coumarin | 0.30 |
| Decyl Aldehyde | 0.50 |
| Dihydro Ambrate | 2.00 |
| Diphenyl Oxide | 0.50 |
| Ethyl-2-methyl Butyrate | 0.15 |
| Eugenol | 0.50 |
| Flor Acetate | 7.00 |
| Frutene | 7.00 |
| Geraniol | 1.00 |
| Geranyl Acetate | 0.10 |
| Geranyl Nitrile | 1.00 |
| Habanolide | 5.00 |
| Hexyl Cinnamic Aldehyde | 15.20 |
| Hexyl Salicylate | 21.00 |
| Iso Bornyl Acetate | 0.40 |
| Iso E Super | 7.00 |
| Lilial | 4.60 |
| Linalool | 1.20 |
| Linalyl Acetate | 2.50 |
| Methyl Cedrylone | 4.00 |
| Orange Oil Cold Pressed | 7.00 |
| Para Cymene | 0.60 |
| Terpineolene | 1.50 |

TABLE 6-continued

| co-pourable perfume | |
|---|---|
| Material Name | Wt % |
| Terpinyl Acetate | 6.00 |
| Triplal | 0.30 |
| Undecalactone | 0.50 |
| Undecylenic Aldehyde | 0.35 |
| Vanillin | 0.10 |
| | 100.00 |

TABLE 7

| detergent-non-copourable perfume (not including polymer, plasticizer, tackifier) | |
|---|---|
| Material Name | Wt. % |
| Benzyl Acetone | 0.20 |
| Citronellol | 3.80 |
| Coumarin | 0.60 |
| Decyl Aldehyde | 1.00 |
| Dihydro Myrcenol | 15.30 |
| Diphenyl Oxide | 1.00 |
| Eugenol | 1.00 |
| Flor Acetate | 7.60 |
| Frutene | 7.60 |
| Geraniol | 1.90 |
| Geranyl Acetate | 0.20 |
| Geranyl Nitrile | 1.90 |
| Habanolide 100% | 3.80 |
| Hexyl Cinnamic Aldehyde | 7.60 |
| Hexyl Salicylate | 9.60 |
| Iso Bornyl Acetate | 0.80 |
| Ligustral | 0.60 |
| Lilial | 5.70 |
| Linalool | 2.30 |
| Linalyl Acetate | 4.80 |
| Orange Oil Cold Pressed | 13.30 |
| Para Cymene | 1.10 |
| Terpineolene | 2.90 |
| Undecalactone | 1.00 |
| Undecylenic Aldehyde | 0.40 |
| Vanillin | 0.20 |
| Vertofix | 3.80 |
| | 100.00 |

Example 7

A product is prepared following the method of Example 1 with the following modifications: The Detergent non-copourable perfume composition of Table 1, Column A is prepared, replacing the Perfume of Table 2 by the perfume of Table 9. The fluid laundry detergent of Table 3, Column B is used, except that the detergent-copourable perfume 1 is as given in Table 8, rather than as given in Table 4.

TABLE 8

| detergent-copourable perfume composition | |
|---|---|
| Material Name | Wt % |
| Benzyl Acetate | 0.50 |
| Benzyl Salicylate | 11.35 |
| Beta Gamma Hexenol | 0.10 |
| Cis-3-hexenyl Alpha Methyl Butyrate | 0.25 |
| Cis-3-hexenyl Salicylate | 1.50 |
| Citronellol | 8.00 |

TABLE 8-continued

| detergent-copourable perfume composition | |
|---|---|
| Material Name | Wt % |
| Citronellyl Nitrile | 1.10 |
| Cyclogalbanate | 0.25 |
| Decyl Aldehyde | 1.00 |
| Dihydro Myrcenol | 3.00 |
| Eugenol | 0.30 |
| Flor Acetate | 4.00 |
| Frutene | 8.00 |
| Geranyl Nitrile | 0.60 |
| Habanolide | 5.00 |
| Hexyl Cinnamic Aldehyde | 10.00 |
| Hexyl Salicylate | 1.00 |
| Ionone Alpha | 2.00 |
| Iso E Super | 4.00 |
| Lilial | 15.00 |
| Linalool | 7.50 |
| Methyl Iso Butenyl Tetrahydro Pyran | 0.10 |
| Methyl Phenyl Carbinyl Acetate | 1.00 |
| Orange Phase Oil | 2.00 |
| Osmanthus base | 5.00 |
| Phenafleur | 0.75 |
| Phenyl Hexanol | 6.00 |
| Triplal | 0.50 |
| Undecalactone | 0.20 |
| | 100 |

TABLE 9

| detergent-non-copourable perfume (not including polymers, plasticizers, tackifiers) | |
|---|---|
| Material Name | Wt. % |
| Alpha Damascone | 0.10 |
| Benzyl Acetate | 1.00 |
| Benzyl Salicylate | 4.00 |
| Beta Gamma Hexenol | 0.15 |
| Cis-3-hexenyl Alpha Methyl Butyrate | 0.30 |
| Cis-3-hexenyl Salicylate | 3.00 |
| Citronellol | 9.00 |
| Citronellyl Nitrile | 1.10 |
| Coumarin | 0.50 |
| Cyclogalbanate | 0.30 |
| Decyl Aldehyde | 1.00 |
| Dihydro Myrcenol | 7.50 |
| Eugenol | 0.30 |
| Flor Acetate | 5.00 |
| Frutene | 9.00 |
| Geraniol | 3.00 |
| Geranyl Nitrile | 0.70 |
| Habanolide | 5.00 |
| Hexyl Cinnamic Aldehyde | 5.00 |
| Hexyl Salicylate | 3.00 |
| Ionone Alpha | 3.00 |
| Iso E Super | 5.00 |
| Labdanum Resin | 0.10 |
| Lauric Aldehyde | 0.95 |
| Lemon Oil California | 1.50 |
| Lilial | 6.00 |
| Linalool | 8.50 |
| Methyl Iso Butenyl Tetrahydro Pyran | 0.10 |
| Methyl Phenyl Carbinyl Acetate | 1.35 |
| Orange Phase Oil | 4.00 |
| Osmanthus base | 4.50 |
| Patchouli | 0.50 |
| Phenafleur | 1.50 |
| Phenyl Hexanol | 2.75 |

TABLE 9-continued

| detergent-non-copourable perfume (not including polymers, plasticizers, tackifiers) | |
|---|---|
| Material Name | Wt. % |
| Triplal Extra | 0.70 |
| Undecalactone | 0.30 |
| Vanillin | 0.30 |

Example 8

A product is prepared following the method of Example 1 with the following modifications: The Detergent non-copourable perfume composition of Table 1, Column A is prepared, replacing the Perfume of Table 2 by the perfume of Table 10. The fluid laundry detergent of Table 3, Column C is used, except that a detergent-copourable perfume is introduced at a level of 0.3% and having the formula of Table 11.

TABLE 10

| detergent-non-copourable perfume (not including polymer, plasticizer, tackifier) | |
|---|---|
| Material Name | Amt |
| Allyl Cyclohexane Propionate | 0.05 |
| Alpha Pinene | 0.30 |
| Amyl Propionate | 0.05 |
| Amyl Salicylate | 8.00 |
| Benzyl Acetone | 2.50 |
| Dihydro Myrcenol | 24.00 |
| Dimethyl Benzyl Carbinyl Butyrate | 0.90 |
| Eucalyptol | 0.10 |
| Flor Acetate | 3.25 |
| Frutene | 36.00 |
| Geraniol | 2.50 |
| Geranyl Acetate | 0.15 |
| Hexyl Cinnamic Aldehyde | 0.20 |
| Hexyl Salicylate | 6.00 |
| Ionone Beta | 3.40 |
| Ionone Gamma Methyl | 0.75 |
| Iso E Super | 0.80 |
| Lemon oil C.P. | 1.00 |
| Linalool | 1.00 |
| Methyl Benzoate | 0.15 |
| Methyl Cedrylone | 0.25 |
| Methyl Phenyl Carbinyl Acetate | 0.25 |
| Ocimenyl Acetate | 0.30 |
| Prenyl Acetate | 0.10 |
| Verdox | 8.00 |
| | 100.00 |

TABLE 11

| detergent-copourable perfume | |
|---|---|
| Material Name | Amt |
| Allyl Cyclohexane Propionate | 0.05 |
| Alpha Pinene | 0.25 |
| Amyl Propionate | 0.05 |
| Amyl Salicylate | 7.40 |
| Benzyl Acetone | 1.90 |
| Dihydro Myrcenol | 18.45 |
| Dimethyl Benzyl Carbinyl Butyrate | 0.75 |

TABLE 11-continued

| detergent-copourable perfume | |
|---|---|
| Material Name | Amt |
| Eucalyptol | 0.05 |
| Flor Acetate | 2.60 |
| Frutene | 28.80 |
| Geraniol | 2.10 |
| Geranyl Acetate | 0.10 |
| Hexyl Cinnamic Aldehyde | 0.15 |
| Hexyl Salicylate | 29.60 |
| Ionone Beta | 2.90 |
| Ionone Gamma Methyl | 0.55 |
| Iso E Super | 0.65 |
| Lemon C.P. | 1.00 |
| Linalool | 0.85 |
| Methyl Benzoate | 0.10 |
| Methyl Cedrylone | 0.20 |
| Methyl Phenyl Carbinyl Acetate | 0.20 |
| Prenyl Acetate | 0.05 |
| Terpinyl Acetate | 0.25 |
| Verdox | 1.00 |
| | 100.00 |

We claim:

1. A laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is selected from:

(1) a detergent-copourable perfume composition;

(2) a fabric care additive;

(3) a laundry-specific detersive additive;

(4) an enzyme;

(5) a volatile malodorous compound; and (6) any combination thereof;

(c) a headspace; and (d) a detergent-non-copourable perfume composition affixed to a solid having dimensions larger than the outlet of the package and floatable in the fluid laundry detergent;

provided that the fluid laundry detergent, the headspace, and the detergent-non-copourable perfume composition are contained together in the package such that when the package is greater than 50% full (v/v) of fluid laundry detergent, the fluid laundry detergent is capable of wetting the detergent-non-copourable perfume composition when the package is inverted; and wherein when the perfume composition (d) is meltable, the pouring temperature thereof is at least 5° C. above the ambient storage temperature.

2. A laundry detergent product of claim 1, wherein the release of perfume from the detergent-non-copourable perfume composition is passive, and wherein the package comprises a pour spout having dimensions sufficient for the fluid laundry detergent to pour from the package without application of a squeezing pressure.

3. A laundry detergent product of claim 2, having a weight ratio of perfume in the detergent-copourable perfume composition to perfume in the detergent-non-copourable perfume composition of from about 0:1 to about 1:0.00001.

4. A laundry detergent product of claim 1, wherein the detergent-non-copourable perfume composition is affixed to an internal portion of the package, provided that when the detergent-non-copourable perfume composition (d) is meltable, the pouring temperature of the detergent-non-copourable perfume composition is at least about 5° C. above the ambient storage temperature.

5. A laundry detergent product of claim 1, wherein the package further comprises a transition component.

6. A laundry detergent product claim 1, wherein the detergent-non-copourable perfume composition is a solidified perfumed hot-melt adhesive.

7. A laundry detergent product of claim 6, wherein the hot-melt adhesive comprises at least one plasticizer, at least one tackifier, or any combination thereof.

8. A laundry detergent product of claim 7, wherein the hot-melt adhesive composition is insoluble in the fluid laundry detergent.

9. A laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is a detergent-copourable perfume composition;

(c) a headspace; and (d) a detergent-non-copourable perfume composition affixed to a solid having dimensions larger than the outlet of the package and floatable in the fluid laundry detergent, wherein when the perfume composition is meltable, the pouring temperature thereof is at least 5° C. above the ambient storage temperature, provided that at least about 0.0001 weight fraction of the perfume of the detergent-copourable perfume composition is incorporated into an amine-assisted delivery matrix, a perfume microcapsule or any combination thereof.

10. A laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is a fabric care additive;

(c) a headspace; and (d) a detergent-non-copourable perfume composition affixed to a solid having dimensions larger than the outlet of the package and floatable in the fluid laundry detergent;

provided that the fluid laundry detergent, the headspace, and the detergent-non-copourable perfume composition are contained together in the package such that when the package is greater than 50% full (v/v) of fluid laundry detergent, the fluid laundry detergent is capable of wetting the detergent-non-copourable perfume composition when the package is inverted; and wherein when the perfume composition (d) is meltable, the pouring temperature thereof is at least 5° C. above the ambient storage temperature.

11. A laundry detergent product of claim 10, wherein the fabric care additive is selected from silicone polymers, cationic fabric softeners, dye fixatives, dye transfer inhibitors, cationic gums, and mixtures thereof.

12. A laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is a laundry-specific detersive additive;

(c) a headspace; and (d) a detergent-non-copourable perfume composition affixed to a solid having dimensions larger than the outlet of the package and floatable in the fluid laundry detergent;

provided that the fluid laundry detergent, the headspace, and the detergent-non-copourable perfume composition are contained together in the package such that when the package is greater than 50% full (v/v) of fluid laundry detergent, the fluid laundry detergent is capable of wetting the detergent-non-copourable perfume composition when the package is inverted; and wherein when the perfume composition (d) is meltable, the pouring temperature thereof is at least 5° C. above the ambient storage temperature.

13. A laundry detergent product of claim 12, wherein the laundry-specific detersive additive is selected from optical brighteners, fabric laundering-compatible nonstaining dyes, fabric compatible bleaches, laundry soil release polymers, laundry soil suspending polymers, or any combination thereof.

14. A laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is an enzyme;

(c) a headspace; and (d) a detergent-non-copourable perfume composition affixed to a solid having dimensions larger than the outlet of the package and floatable in the fluid laundry detergent;

provided that the fluid laundry detergent, the headspace, and the detergent-non-copourable perfume composition are contained together in the package such that when the package is greater than 50% full (v/v) of fluid laundry detergent, the fluid laundry detergent is capable of wetting the detergent-non-copourable perfume composition when the package is inverted; and wherein when the perfume composition (d) is meltable, the pouring temperature thereof is at least 5° C. above the ambient storage temperature.

15. A laundry detergent product of claim 14, wherein the enzyme is selected from a proteolytic enzyme, a lipolytic enzyme, an amylolytic enzyme, a cellulolytic enzyme, or any combination thereof.

16. A laundry detergent product of claim 14, further comprising enzyme destabilizing perfumery aldehydes, ketones and/or terpenes at elevated levels in said detergent-non-copourable perfume composition relative to the levels of these materials in the detergent-copourable perfume composition.

17. A laundry detergent product of claim 16, wherein more than half of the total amount of enzyme-destabilizing perfume raw materials in the laundry detergent product is incorporated into the detergent-non-copourable perfume composition.

18. A laundry detergent product comprising (a) a package comprising (1) a container; and (2) a closure;

(b) a fluid laundry detergent pourable at ambient storage temperature and comprising at least one material copourable from the package with the fluid laundry detergent, wherein the material is a volatile malodorous compound;

(c) a headspace; and (d) a detergent-non-copourable perfume composition affixed to a solid having dimensions larger than the outlet of the package and floatable in the fluid laundry detergent;

provided that the fluid laundry detergent, the headspace, and the detergent-non-copourable perfume composition are contained together in the package such that when the package is greater than 50% full (v/v) of fluid laundry detergent, the fluid laundry detergent is capable of wetting the detergent-non-copourable perfume composition when the package is inverted; and wherein when the perfume composition (d) is meltable, the pouring temperature thereof is at least 5° C. above the ambient storage temperature.

19. A laundry detergent product of claim 18, wherein the volatile malodorous compound is selected from fatty acid derived malodorous compounds, synthetic amine derived malodorous compounds, enzyme derived malodorous compounds and mixtures thereof.

20. A laundry detergent product of claim 1, wherein the detergent-non-copourable perfume composition is self-adhering.

21. A laundry detergent product of claim 1, wherein the detergent-non-copourable perfume composition further comprises an adhesive for affixing the detergent-non-copourable perfume composition to the package.

22. A laundry detergent product of claim 20, wherein the amount of perfume in the detergent-non-copourable perfume composition is from about 1 to 80 wt % of the detergent-non-copourable perfume composition, the balance of the detergent-non-copourable perfume composition comprising thermoplastic polymers, plasticizers, tackifiers, or any combination thereof.

23. A laundry detergent product of claim 1, wherein at least one of the detergent-copourable perfume composition and the detergent-non-copourable perfume composition comprises at least five components.

24. A laundry detergent product of claim 23, wherein the detergent-copourable perfume composition has an olfactory character matching that of the detergent-non-copourable perfume composition.

25. A laundry detergent product of claim 23, wherein the detergent-copourable perfume composition has an olfactory character differing from that of the detergent-non-copourable perfume composition.

26. A laundry detergent product of claim 1, wherein the fluid laundry detergent further comprises up to 90 wt % of one or more detersive surfactants, detersive builders, enzyme stabilizers, suds suppressors, chelating agents, thickeners, opacifiers, pigments or any combination thereof.

27. A laundry detergent product of claim 1 further comprising detersive surfactant having a hydrophilic index value, HIc, of from about 8 to about 9.2.

28. A laundry detergent product of claim 27 comprising from about 5 to about 50 wt % of said detersive surfactant.

* * * * *

UNITED STATES PATENT AND TRADEMARK OFFICE

CERTIFICATE OF CORRECTION

PATENT NO. : 7,790,662 B2
APPLICATION NO. : 11/516355
DATED : September 7, 2010
INVENTOR(S) : Sahin Topkara et al.

It is certified that error appears in the above-identified patent and that said Letters Patent is hereby corrected as shown below:

Column 10, lines 5-6;
Before "co-pourable composition" insert therefor --weight ratio of perfume in the detergent--.

Signed and Sealed this
Twenty-first Day of June, 2011

David J. Kappos

David J. Kappos
*Director of the United States Patent and Trademark Office*